US010062968B2

(12) United States Patent
Bily et al.

(10) Patent No.: US 10,062,968 B2
(45) Date of Patent: Aug. 28, 2018

(54) SURFACE SCATTERING ANTENNAS

(71) Applicant: Searete LLC, Bellevue, WA (US)

(72) Inventors: Adam Bily, Seattle, WA (US); Anna K. Boardman, Allston, MA (US); Russell J. Hannigan, Sammamish, WA (US); John Desmond Hunt, Seattle, WA (US); Nathan Kundtz, Kirkland, WA (US); David R. Nash, Arlington, WA (US); Ryan Allan Stevenson, Woodinville, WA (US); Philip A. Sullivan, Bozeman, MT (US)

(73) Assignee: The Invention Science Fund I LLC

( * ) Notice: Subject to any disclaimer, the term of this patent is extended or adjusted under 35 U.S.C. 154(b) by 0 days.

(21) Appl. No.: 15/164,211

(22) Filed: May 25, 2016

(65) Prior Publication Data

US 2016/0372834 A1 Dec. 22, 2016

Related U.S. Application Data

(63) Continuation of application No. 13/317,338, filed on Oct. 14, 2011, now Pat. No. 9,450,310, and a (Continued)

(51) Int. Cl.
*H01Q 15/10* (2006.01)
*H01Q 13/28* (2006.01)
(Continued)

(52) U.S. Cl.
CPC ..... *H01Q 15/10* (2013.01); *H01Q 3/00* (2013.01); *H01Q 13/28* (2013.01); (Continued)

(58) Field of Classification Search
CPC ..... H01Q 13/28; H01Q 15/10; H01Q 3/00; H01Q 15/02
See application file for complete search history.

(56) References Cited

U.S. PATENT DOCUMENTS 3,001,193 A 9/1961 Marie
3,388,396 A 6/1968 Rope et al.
(Continued)

FOREIGN PATENT DOCUMENTS

JP 52-13751 A 2/1977
JP 06-090110 3/1994
(Continued)

OTHER PUBLICATIONS

Extended European Search Report; European App. No. EP 14 77 0686; dated Oct. 14, 2016; pp. 1-7.
(Continued)

*Primary Examiner* — Andrea Lindgren Baltzell

(57) ABSTRACT

Surface scattering antennas provide adjustable radiation fields by adjustably coupling scattering elements along a wave-propagating structure. In some approaches, the scattering elements are complementary metamaterial elements. In some approaches, the scattering elements are made adjustable by disposing an electrically adjustable material, such as a liquid crystal, in proximity to the scattering elements. Methods and systems provide control and adjustment of surface scattering antennas for various applications.

36 Claims, 16 Drawing Sheets

Related U.S. Application Data continuation of application No. 14/596,807, filed on Jan. 14, 2015.

(60) Provisional application No. 61/455,171, filed on Oct. 15, 2010.

(51) Int. Cl.
*H01Q 15/00* (2006.01)
*H01Q 15/02* (2006.01)
*H01Q 3/00* (2006.01)

(52) U.S. Cl.
CPC ..... *H01Q 15/0006* (2013.01); *H01Q 15/0066* (2013.01); *H01Q 15/0086* (2013.01); *H01Q 15/02* (2013.01)

(56) References Cited

U.S. PATENT DOCUMENTS 3,714,608 A 1/1973 Barnes et al.
3,757,332 A 9/1973 Tricoles
3,887,923 A 6/1975 Hendrix
4,195,262 A 3/1980 King
4,291,312 A 9/1981 Kaloi
4,305,153 A 12/1981 King
4,489,325 A 12/1984 Bauck et al.
4,509,209 A 4/1985 Itoh et al.
4,672,378 A 6/1987 Drabowitch et al.
4,701,762 A 10/1987 Apostolos
4,780,724 A 10/1988 Sharma et al.
4,832,429 A 5/1989 Nagler
4,874,461 A 10/1989 Sato et al.
4,920,350 A 4/1990 McGuire et al.
4,947,176 A 8/1990 Inatsune et al.
4,978,934 A 12/1990 Saad
5,198,827 A 3/1993 Seaton
5,455,590 A 10/1995 Collins et al.
5,512,906 A 4/1996 Speciale
5,734,347 A 3/1998 McEligot
5,841,543 A 11/1998 Guldi et al.
5,889,599 A 3/1999 Takemori
6,031,506 A 2/2000 Cooley et al.
6,061,023 A 5/2000 Daniel et al.
6,061,025 A 5/2000 Jackson et al.
6,075,483 A 6/2000 Gross
6,084,540 A 7/2000 Yu
6,114,834 A 9/2000 Parise
6,166,690 A 12/2000 Lin et al.
6,198,453 B1 3/2001 Chew
6,211,823 B1 4/2001 Herring
6,232,931 B1 5/2001 Hart
6,236,375 B1 5/2001 Chandler et al.
6,275,181 B1 8/2001 Kitayoshi
6,366,254 B1 4/2002 Sievenpiper et al.
6,384,797 B1 5/2002 Schaffner et al.
6,396,440 B1 5/2002 Chen
6,469,672 B1 10/2002 Marti-Canales et al.
6,545,645 B1 4/2003 Wu
6,552,696 B1 4/2003 Sievenpiper et al.
6,633,026 B2 10/2003 Tuominen
6,985,107 B2 1/2006 Anson et al.
7,068,234 B2 6/2006 Sievenpiper
7,151,499 B2 12/2006 Avakian et al.
7,154,451 B1 12/2006 Sievenpiper
7,162,250 B2 1/2007 Misra
7,253,780 B2 8/2007 Sievenpiper
7,295,146 B2 11/2007 McMakin et al.
7,307,596 B1 12/2007 West
7,339,521 B2 3/2008 Scheidemann et al.
7,428,230 B2 9/2008 Park
7,456,787 B2 11/2008 Manasson et al.
7,609,223 B2 10/2009 Manasson et al.
7,667,660 B2 2/2010 Manasson et al.
7,830,310 B1 11/2010 Sievenpiper et al.
7,834,795 B1 11/2010 Dudgeon et al.
7,864,112 B2 1/2011 Manasson et al.
7,911,407 B1 3/2011 Fong et al.
7,929,147 B1 4/2011 Fong et al.
7,995,000 B2 8/2011 Manasson et al.
8,009,116 B2 8/2011 Peichl et al.
8,014,050 B2 9/2011 McGrew
8,040,586 B2 10/2011 Smith et al.
8,059,051 B2 11/2011 Manasson et al.
8,134,521 B2 3/2012 Herz et al.
8,179,331 B1 5/2012 Sievenpiper
8,212,739 B2 7/2012 Sievenpiper
8,339,320 B2 12/2012 Sievenpiper
8,456,360 B2 6/2013 Manasson et al.
9,231,303 B2 1/2016 Edelmann et al.
9,268,016 B2 2/2016 Smith et al.
9,385,435 B2 7/2016 Bily et al.
9,389,305 B2 7/2016 Boufounos
9,450,310 B2 9/2016 Bily et al.
9,634,736 B2 4/2017 Mukherjee et al.
2002/0039083 A1 4/2002 Taylor et al.
2002/0167456 A1 11/2002 McKinzie, III
2003/0214443 A1 11/2003 Bauregger et al.
2004/0227668 A1 11/2004 Sievenpiper
2004/0263408 A1 12/2004 Sievenpiper et al.
2005/0031295 A1 2/2005 Engheta et al.
2005/0088338 A1 4/2005 Masenten et al.
2006/0065856 A1 3/2006 Diaz et al.
2006/0114170 A1 6/2006 Sievenpiper
2006/0116097 A1 6/2006 Thompson
2006/0132369 A1 6/2006 Robertson et al.
2006/0187126 A1 8/2006 Sievenpiper
2007/0085757 A1 4/2007 Sievenpiper
2007/0103381 A1 5/2007 Upton
2007/0159395 A1 7/2007 Sievenpiper et al.
2007/0159396 A1 7/2007 Sievenpiper et al.
2007/0182639 A1 8/2007 Sievenpiper et al.
2007/0200781 A1 8/2007 Ahn et al.
2007/0229357 A1 10/2007 Zhang et al.
2008/0020231 A1 1/2008 Yamada et al.
2008/0165079 A1 7/2008 Smith et al.
2008/0180339 A1 7/2008 Yagi
2008/0224707 A1 9/2008 Wisler et al.
2008/0259826 A1 10/2008 Struhsaker
2008/0268790 A1 10/2008 Shi et al.
2008/0316088 A1 12/2008 Pavlov et al.
2009/0002240 A1 1/2009 Sievenpiper et al.
2009/0045772 A1 2/2009 Cook et al.
2009/0109121 A1 4/2009 Herz et al.
2009/0147653 A1 6/2009 Waldman et al.
2009/0195361 A1 8/2009 Smith
2009/0251385 A1 10/2009 Xu et al.
2010/0066629 A1 3/2010 Sievenpiper
2010/0073261 A1 3/2010 Sievenpiper
2010/0079010 A1 4/2010 Hyde et al.
2010/0109972 A2* 5/2010 Xu ..... H01Q 15/008 343/911 R
2010/0134370 A1 6/2010 Oh et al.
2010/0156573 A1 6/2010 Smith et al.
2010/0157929 A1 6/2010 Karabinis
2010/0188171 A1 7/2010 Mohajer-Iravani et al.
2010/0279751 A1 11/2010 Pourseyed et al.
2010/0328142 A1 12/2010 Zoughi et al.
2011/0065448 A1 3/2011 Song et al.
2011/0098033 A1 4/2011 Britz et al.
2011/0117836 A1 5/2011 Zhang et al.
2011/0128714 A1 6/2011 Terao et al.
2011/0151789 A1 6/2011 Viglione et al.
2011/0267664 A1 11/2011 Kitamura et al.
2012/0026068 A1 2/2012 Sievenpiper
2012/0038317 A1 2/2012 Miyamoto et al.
2012/0112543 A1 5/2012 van Wageningen et al.
2012/0194399 A1 8/2012 Bily et al.
2012/0219249 A1 8/2012 Pitwon
2012/0268340 A1 10/2012 Capozzoli et al.
2012/0274147 A1 11/2012 Stecher et al.
2012/0280770 A1 11/2012 Abhari et al.
2012/0326660 A1 12/2012 Lu et al.
2013/0069865 A1 3/2013 Hart
2013/0082890 A1 4/2013 Wang et al.

(56) References Cited

U.S. PATENT DOCUMENTS

| | | | |
|---|---|---|---|
| 2013/0237272 | A1 | 9/2013 | Prasad |
| 2013/0249310 | A1 | 9/2013 | Hyde et al. |
| 2013/0278211 | A1 | 10/2013 | Cook et al. |
| 2013/0288617 | A1 | 10/2013 | Kim et al. |
| 2013/0324076 | A1 | 12/2013 | Harrang |
| 2013/0343208 | A1 | 12/2013 | Sexton et al. |
| 2014/0128006 | A1 | 5/2014 | Hu |
| 2014/0266946 | A1 | 9/2014 | Bily et al. |
| 2015/0189568 | A1 | 7/2015 | Stanze et al. |
| 2015/0280444 | A1 | 10/2015 | Smith et al. |
| 2017/0098961 | A1 | 4/2017 | Harpham |
| 2017/0250746 | A1 | 8/2017 | Wang et al. |

FOREIGN PATENT DOCUMENTS

| | | | |
|---|---|---|---|
| JP | 2007-081825 | A | 3/2007 |
| JP | 2008-054146 | A | 3/2008 |
| JP | 2010-187141 | A | 8/2010 |
| JP | 2012085145 | A | 4/2012 |
| KR | 10-1045585 | B1 | 6/2011 |
| WO | WO 01/73891 | A1 | 10/2001 |
| WO | WO 2008-007545 | A1 | 1/2008 |
| WO | WO 2008/059292 | A2 | 5/2008 |
| WO | WO 2009/103042 | | 8/2009 |
| WO | WO 2009/103042 | A2 | 8/2009 |
| WO | WO 2010/0021736 | | 2/2010 |
| WO | WO 2012/050614 | A1 | 4/2012 |
| WO | PCT/US2013/212504 | | 5/2013 |
| WO | WO 2013/147470 | A1 | 10/2013 |

OTHER PUBLICATIONS

The State Intellectual Property Office of P.R.C., Fifth Office Action, App. No. 2011/80055705.8 (Based on PCT Patent Application No. PCT/US2011/001755); dated Nov. 16, 2016 ; pp. 1-3 (machine translation, as provided).

Canadian Intellectual Property Office, Canadian Examination Search Report, Pursuant to Subsection 30(2); App. No. 2,814,635; dated Dec. 1, 2016; pp. 1-3.

PCT International Search Report; International App. No. PCT/US2016/037667; dated Sep. 7, 2016; pp. 1-3.

European Search Report; European App. No. EP 11 832 873.1; dated Sep. 21, 2016; pp. 1-6.

Ayob et al.; "A Survey of Surface Mount Device Placement Machine Optimisation: Machine Classification"; Computer Science Technical Report No. NOTTCS-TR-2005-8; Sep. 2005; pp. 1-34.

"Aperture", Definition of Aperture by Merriam-Webster; located at http://www.merriam-webster.com/dictionary/aperture; pp. 1-9; Merriam-Webster, Incorporated.

PCT International Preliminary Report on Patentability; International App. No. PCT/US2014/070645; dated Jun. 21, 2016; pp. 1-12.

Abdalla et al.; "A Planar Electronically Steerable Patch Array Using Tunable PRI/NRI Phase Shifters"; IEEE Transactions on Microwave Theory and Techniques; Mar. 2009; p. 531-541; vol. 57, No. 3; IEEE.

Courreges et al.; "Electronically: Tunable Ferroelectric Devices for Microwave Applications"; *Microwave and Millimeter Wave Technologies from Photonic Bandgap Devices to Antenna and Applications*; ISBN 978-953-7619-66-4; Mar. 2010; p. 185-204; InTech.

Cristaldi et al., Chapter 3 "Passive LCDs and Their Addressing Techniques" and Chapter 4 "Drivers for Passive-Matrix LCDs"; *Liquid Crystal Display Drivers: Techniques and Circuits*: ISBN 9048122546; Apr. 8, 2009; p. 75-143; Springer.

Elliott, R.S.; "An Improved Design Procedure for Small Arrays of Shunt Slots"; Antennas and Propagation, IEEE Transaction on; Jan. 1983; p. 297-300; vol. 31, Issue: 1; IEEE.

Elliott, Robert S. and Kurtz, L.A.; "The Design of Small Slot Arrays"; Antennas and Propagation, IEEE Transactions on; Mar. 1978; p. 214-219; vol. AP-26, Issue 2; IEEE.

Evlyukhin, Andrey B. and Bozhevolnyi, Sergey I.; "Holographic evanescent-wave focusing with nanoparticle arrays"; Optics Express; Oct. 27, 2008; p. 17429-17440; vol. 16, No. 22; OSA.

Fong, Bryan H. et al.; "Scalar and Tensor Holographic Artificial Impedance Surfaces" IEEE Transactions on Antennas and Propagation; Oct. 2010; p. 3212-3221; vol. 58, No. 10; IEEE.

Fan, Yun-Hsing et al.; "Fast-response and scattering-free polymer network liquid crystals for infrared light modulators"; Applied Physics Letters; Feb. 23, 2004; p. 1233-1235; vol. 84, No. 8; American Institute of Physics.

Kaufman, D.Y. et al.; "High-Dielectric-Constant Ferroelectric Thin Film and Bulk Ceramic Capacitors for Power Electronics"; Proceedings of the Power Systems World/Power Conversion and Intelligent Motion '99 Conference; Nov. 6-12, 1999; p. 1-9; PSW/PCIM; Chicago, IL.

Kim, David Y.; "A Design Procedure for Slot Arrays Fed by Single-Ridge Waveguide"; IEEE Transactions on Antennas and Propagation; Nov. 1988; p. 1531-1536; vol. 36, No. 11; IEEE.

Kokkinos, Titos et al.; "Periodic FDTD Analysis of Leaky-Wave Structures and Applications to the Analysis of Negative-Refractive-Index Leaky-Wave Antennas"; IEEE Transactions on Microwave Theory and Techniques; 2006; p. 1-12; ; IEEE.

Kuki, Takao et al., "Microwave Variable Delay Line using a Membrane Impregnated with Liquid Crystal"; Microwave Symposium Digest; ISBN 0-7803-7239-5; Jun. 2-7, 2002; p. 363-366; IEEE MTT-S International.

Poplavlo, Yuriy et al.; "Tunable Dielectric Microwave Devices with Electromechanical Control"; *Passive Microwave Components and Antennas*; ISBN 978-953-307-083-4; Apr. 2010; p. 367-382; InTech.

Rengarajan, Sembiam R. et al.; "Design, Analysis, and Development of a Large Ka-Band Slot Array for Digital Beam-Forming Application"; IEEE Transactions on Antennas and Propagation; Oct. 2009; p. 3103-3109; vol. 57, No. 10; IEEE.

Sato, Kazuo et al.; "Electronically Scanned Left-Handed Leaky Wave Antenna for Millimeter-Wave Automotive Applications"; Antenna Technology Small Antennas and Novel Metamaterials; 2006; p. 420-423; IEEE.

Sievenpiper, Dan et al.; "Holographic Artificial Impedance Surfaces for Conformal Antennas"; Antennas and Propagation Society International Symposium; 2005; p. 256-259; vol. 1B; IEEE, Washington D.C.

Sievenpiper, Daniel F. et al.; "Two-Dimensional Beam Steering Using an Electrically Tunable Impedance Surface"; IEEE Transactions on Antennas and Propagation; Oct. 2003; p. 2713-2722; vol. 51, No. 10; IEEE.

Utsumi, Yozo et al.; "Increasing the Speed of Microstrip-Line-Type Polymer-Dispersed Liquid-Crystal Loaded Variable Phase Shifter"; IEEE Transactions on Microwave Theory and Techniques; Nov. 2005, p. 3345-3353; vol. 53, No. 11; IEEE.

Weil, Carsten et al.; "Tunable Inverted-Microstrip Phase Shifter Device Using Nematic Liquid Crystals"; IEEE MTT-S Digest; 2002; p. 367-370; IEEE.

Yee, Hung Y.; "Impedance of a Narrow Longitudinal Shunt Slot in a Slotted Waveguide Array"; IEEE Transactions on Antennas and Propagation; Jul. 1974; p. 589-592; IEEE.

Zhong, S.S. et al.; "Compact ridge waveguide slot antenna array fed by convex waveguide divider"; Electronics Letters; Oct. 13, 2005; p. 1-2; vol. 41, No. 21; IEEE.

Amineh et al.; "Three-Dimensional Near-Field Microwave Holography for Tissue Imaging"; International Journal of Biomedical Imaging; Bearing a date of Dec. 21, 2011; pp. 1-11; vol. 2012, Article ID 291494; Hindawi Publishing Corporation.

Belloni, Fabio; "Channel Sounding"; S-72.4210 PG Course in Radio Communications; Bearing a date of Feb. 7, 2006; pp. 1-25.

Diaz, Rudy; "Fundamentals of EM Waves"; Bearing a date of Apr. 4, 2013; 6 Total Pages; located at: http://www.microwaves101.com/encyclopedia/absorbingradar1.cfm.

Frenzel, Lou; "What's The Difference Between EM Near Field and Far Field?"; Electronic Design; Bearing a date of Jun. 8, 2012; 7 Total Pages; located at http://electronicdesign.com/energy/what-s-difference-between-em-near-field-and-far-field.

(56) References Cited

OTHER PUBLICATIONS

Grbic, Anthony; "Electrical Engineering and Computer Science"; University of Michigan; Created on Mar. 18, 2014, printed on Jan. 27, 2014; pp. 1-2; located at: http://sitemaker.umich.edu/agrbic/projects.
Grbic et al.; "Metamaterial Surfaces for Near and Far-Field Applications"; 7th European Conference on Antennas and Propagation (EUCAP 2013); Bearing a date of 2013; Created on Mar. 18, 2014; pp. 1-5.
Imani, et al.; "A Concentrically Corrugated Near-Field Plate"; Bearing a date of 2010, Created on Mar. 18, 2014; pp. 1-4; IEEE.
Imani, et al.; "Design of a Planar Near-Field Plate"; Bearing a date of 2012, Created on Mar. 18, 2014; pp. 1-2; IEEE.
Imani, et al.; "Planar Near-Field Plates"; Bearing a date of 2013, Created on Mar. 18, 2014; pp. 1-10; IEEE.
Islam et al.; "A Wireless Channel Sounding System for Rapid Propagation Measurements"; Bearing a date of Nov. 21, 2012; 7 Total Pages.
Konishl Yohei; "Channel Sounding Technique Using MIMO Software Radio Architecture"; 12th MCRG Joint Seminar, Bearing a date of Nov. 18, 2010; 28 Total Pages.
Lipworth et al.; "Magnetic Metamaterial Superlens for Increased Range Wireless Power Transfer"; Scientific Reports; Bearing a date of Jan. 10, 2014; pp. 1-6; vol. 4, No. 3642
Manasson et al.; "Electronically Reconfigurable Aperture (ERA): A New Approach for Beam-Steering Technology"; Bearing dates of Oct. 12-15, 2010; pp. 673-679; IEEE.
Mitri, F.G.; "Quasi-Gaussian Electromagnetic Beams"; Physical Review A.; Bearing a date of Mar. 11, 2013; p. 1; vol. 87, No. 035804; (Abstract Only).
Sakakibara, Kunio; "High-Gain Millimeter-Wave Planar Array Antennas with Traveling-Wave Excitation"; Radar Technology, Bearing a date of Dec. 2009; pp. 319-340.
Sandell et al.; "Joint Data Detection and Channel Sounding for TDD Systems with Antenna Selection"; Bearing a date of 2011, Created on Mar. 18, 2014; pp. 1-5; IEEE.
Siciliano et al.; "25. Mtiltisensor Data Fusion"; Springer Handbook of Robotics; Bearing a date of 2008, Created on Mar. 18, 2014; 27 Total Pages; Springer.
Thoma et al.; "MIMO Vector Channel Sounder Measurement for Smart Antenna System Evaluation"; Created on Mar. 18, 2014; pp. 1-12.
Umenei A.E.; "Understanding Low Frequency Non-Radiative Power Transfer"; Bearing a date of Jun. 2011; 7 Total Pages; Fulton Innovation, LLC.
Wallace, John; "Flat 'Metasurface' Becomes Aberration-Free Lens"; Bearing a date of Aug. 28, 2012; 4 Total Pages; located at: http://www.laserfocusworld.com/articles/2012/08/flat-metasurface-becomes-aberration-free-lens.html.
Yoon et al.; "Realizing Efficient Wireless Power Transfer in the Near-Field Region Using Electrically Small Antennas"; Wireless Power Transfer; Principles and Engineering Explorations; Bearing a date of Jan. 25, 2012; pp. 151-172.
PCT International Search Report; International App. No. PCT/US2014/070645; dated Mar. 16, 2015; pp. 1-3.
PCT International Search Report; International App. No. PCT/US2011/001755; dated Mar. 22, 2012; pp. 1-5.
PCT International Search Report; International App. No. PCT/US2014/070650; dated Mar. 27, 2015; pp. 1-3.
The State Intellectual Property Office of P.R.C.; Application No. 201180055705.8; May 6, 2015; pp. 1-11.
Intellectual Property Office of Singapore Examination Report; Application No. 2013027842; Feb. 27, 2015; pp. 1-12.
European Patent Office, Supplementary European Search Report, pursuant to Rule 62 EPC; App. No. EP 11 83 2873; dated May 15, 2014; 7 pages.
U.S. Appl. No. 13/838,934, Bily et al.
Colburn et al.; "Adaptive Artificial Impedance Surface Conformal Antennas"; in Proc. IEEE Antennas and Propagation Society Int. Symp.; 2009; p. 1-4.
Hand, Thomas H. et al.; "Characterization of complementary electric field coupled resonant surfaces"; Applied Physics Letters; published on Nov. 26, 2008; pp. 212504-1-212504-3; vol. 93; Issue 21; American Institute of Physics.
McLean et al.; "Interpreting Antenna Performance Parameters for EMC Applications: Part 2: Radiation Pattern, Gain, and Directivity"; Created on Apr. 1, 2014; pp. 7-17; TDK RF Solutions Inc.
Soper, Taylor; "This startup figured out how to charge devices wirelessly through walls from 40 feet away"; GeekWire; bearing a date of Apr. 22, 2014 and printed on Apr. 24, 2014; pp. 1-12; located at http://www.geekwire.com/2014/ossia-wireless-charging/#disqus_thread.
"Wavenumber"; Microwave Encyclopedia; Bearing a date of Jan. 12, 2008; pp. 1-2; P-N Designs, Inc.
Fan, Guo-Xin et al.; "Scattering from a Cylindrically Conformal Slotted Waveguide Array Antenna"; IEEE Transactions on Antennas and Propagation; Jul. 1997; pp. 1150-1159; vol. 45, No. 7; IEEE.
Jiao, Yong-Chang et al.; A New Low-Side-Lobe Pattern Synthesis Technique for Conformal Arrays; IEEE Transactions on Antennas and Propagation; Jun. 1993; pp. 824-831, vol. 41, No. 6; IEEE.
Ovi et al.; "Symmetrical Slot Loading in Elliptical Microstrip Patch Antennas Partially Filled with Mue Negative Metamaterials"; PIERS Proceedings, Moscow, Russia; Aug. 19-23, 2012; pp. 542-545.
PCT International Search Report; International App. No. PCT/US2014/017454; dated Aug. 28, 2014; pp. 1-4.
PCT International Search Report; International App. No. PCT/US2015/028781; dated Jul. 27, 2015; pp. 1-3.
PCT International Search Report; International App. No. PCT/US2014/061485; dated Jul. 27, 2015; pp. 1-3.
PCT International Search Report; International App. No. PCT/US2015/036638; dated Oct. 19, 2015; pp. 1-4.
Patent Office of the Russian Federation (Rospatent) Office Action; Application No. 2013119332/28(028599); dated Oct. 13, 2015; machine translation; pp. 1-5.
"Array Antenna with Controlled Radiation Pattern Envelope Manufacture Method"; ESA; Jan. 8, 2013; pp. 1-2; http://www.esa.int/Our_Activities/Technology/Array_antenna_with_controlled_radiation_pattern_envelope_manufacture_method.
Crosslink; Summer 2002; pp. 1-56 vol. 3; No. 2; The Aerospace Corporation.
Leveau et al.; "Anti-Jam Protection by Antenna"; GPS World; Feb. 1, 2013; pp. 1-11; North Coast Media LLC; http://gpsworld.com/anti-jam-protection-by-antenna/.
Luo et al.; "High-directivity antenna with small antenna aperture"; Applied Physics Letters; 2009; pp. 193506-1-193506-3; vol. 95; American Institute of Physics.
Smith, David R.; "Recent Progress in Metamaterial and Transformation Optical Design"; NAVAIR Nano/Meta Workshop; Feb. 2-3, 2011; pp. 1-32.
"Spectrum Analyzer"; Printed on Aug. 12, 2013; pp. 1-2; http://www.gpssource.com/faqs/15; GPS Source.
Sun et al.; "Maximum Signal-to-Noise Ratio GPS Anti-Jam Receiver with Subspace Tracking"; ICASSP; 2005; pp. IV-1085-IV-1088; IEEE.
The State Intellectual Property Office of P.R.C.; Application No. 201180055705.8; Nov. 4, 2015; pp. 1-11.
PCT International Search Report; International App. No. PCT/US2014/069254; dated Nov. 27, 2015; pp. 1-4.
Chen, Robert; *Liquid Crystal Displays*, Wiley, New Jersey 2011 (not provided).
Chin J.Y. et al.; "An efficient broadband metamaterial wave retarder"; Optics Express; vol. 17, No. 9; p. 7640-7647; 2009.
Chu R.S. et al.; "Analytical Model of a Multilayered Meaner-Line Polarizer Plate with Normal and Oblique Plane-Wave Incidence"; IEEE Trans. Ant. Prop.; vol. AP-35, No. 6; p. 652-661; Jun. 1987.
Den Boer, Wilem: *Active Matrix Liquid Crystal Displays*; Elsevier, Burlington, MA, 2009 (not provided).
Kirschbaum, H.S. et al.; "A Method of Producing Broad-Band Circular Polarization Employing an Anisotropic Dielectric"; IRE Trans. Micro. Theory. Tech.; vol. 5, No. 3; p. 199-203; 1957.

(56) References Cited

OTHER PUBLICATIONS

Yan, Dunbao et al.; "A Novel Polarization Convert Surface Based on Artificial Magnetic Conductor"; Asia-Pacific Microwave Conference Proceedings, 2005.
Young et al.; "Meander-Line Polarizer"; IEEE Trans. Ant. Prop.; p. 376-378; May 1973.
Definition from Merriam-Webster Online Dictionary; "Integral"; Merriam-Webster Dictionary; pp. 1-5; located at: http://www.merriam-webster.com/dictionary/integral.
IP Australia Patent Examination Report No. 1; Patent Application No. 2011314378; dated Mar. 4, 2016; pp. 1-4.
P.K. Varlamos and C.N. Capsalis, Electronic Beam Steering Using Switched Parasitic Smart Antenna Arrays, Progress in Electromagnetics Research, PIER 36, 101-119, 2002.
European Patent Office, Supplementary European Search Report, Pursuant to Rule 62 EPC; App. No. EP 14891152; dated Jul. 20, 2017; pp. 1-4.
Supplementary European Search Report, Pursuant to Rule 62 EPC; App. No. EP 14 87 2595; dated Jul. 3, 2017; pp. 1-16.
Supplementary European Search Report, Pursuant to Rule 62 EPC; App. No. EP 14 87 2874; dated Jul. 3, 2017; pp. 1-15.
European Patent Office, Supplementary European Search Report, Pursuant to Rule 62 EPC; App. No. EP 15 80 8884 ; dated Jan. 9, 2018; pp. 1-12.
Chinese State Intellectual Property Office, Notification of Fourth Office Action, App. No. 2011/80055705.8 (Based on PCT Patent Application No. PCT/US2011/001755); dated May 20, 2016; pp. 1-4 (machine translation only).
Japan Patent Office, Office Action, App. No. 2016-500314 (based on PCT Patent Application No. PCT/US2014/017454); dated Mar. 6, 2018; pp. 1-4.

* cited by examiner

SURFACE SCATTERING ANTENNAS

CROSS-REFERENCE TO RELATED APPLICATIONS

The present application is related to and claims the benefit of the earliest available effective filing date(s) from the following listed application(s) (the "Related Applications") (e.g., claims earliest available priority dates for other than provisional patent applications or claims benefits under 35 USC § 119(e) for provisional patent applications, for any and all parent, grandparent, great-grandparent, etc. applications of the Related Application(s)). All subject matter of the Related Applications and of any and all parent, grandparent, great-grandparent, etc. applications of the Related Applications, including any priority claims, is incorporated herein by reference to the extent such subject matter is not inconsistent herewith.

RELATED APPLICATIONS

The present application constitutes a continuation-in-part of U.S. patent application Ser. No. 13/317,338, entitled SURFACE SCATTERING ANTENNAS, naming ANAM BILY, ANNA K BOARDMAN, RUSSELL J. HANNIGAN, JOHN HUNT, NATHAN KUNDTZ, DAVID R. NASH, RYAN ALLAN STEVENSON, and PHILIP A. SULLIVAN as inventors, filed 14 Oct. 2011, which is an application of which a currently application is entitled to the benefit of the filing date, and which is a continuation of U.S. Patent Application No. 61/455,171, entitled SURFACE SCATTERING ANTENNAS, naming NATHAN KUNDTZ et al. as inventors, filed 15 Oct. 2010.

For purposes of the USPTO extra-statutory requirements, the present application constitutes a continuation-in-part of U.S. Patent Application No. 61/455,171, entitled SURFACE SCATTERING ANTENNAS, naming NATHAN KUNDTZ ET AL. as inventors, filed 15, Oct., 2010, which is is an application of which application is entitled to the benefit of the filing date.

The United States Patent Office (USPTO) has published a notice to the effect that the USPTO's computer programs require that patent applicants reference both a serial number and indicate whether an application is a continuation, continuation-in-part, or divisional of a parent application. Stephen G. Kunin, *Benefit of Prior Filed Application*, USPTO Official Gazette Mar. 18, 2003. The present Applicant Entity (hereinafter "Applicant") has provided above a specific reference to the application(s) from which priority is being claimed as recited by statute. Applicant understands that the statute is unambiguous in its specific reference language and does not require either a serial number or any characterization, such as "continuation" or "continuation-in-part," for claiming priority to U.S. patent applications. Notwithstanding the foregoing, Applicant understands that the USPTO's computer programs have certain data entry requirements, and hence Applicant has provided designation(s) of a relationship between the present application and its parent application(s) as set forth above, but expressly points out that such designation(s) are not to be construed in any way as any type of commentary and/or admission as to whether or not the present application contains any new matter in addition to the matter of its parent application(s).

DETAILED DESCRIPTION

Figure 1:
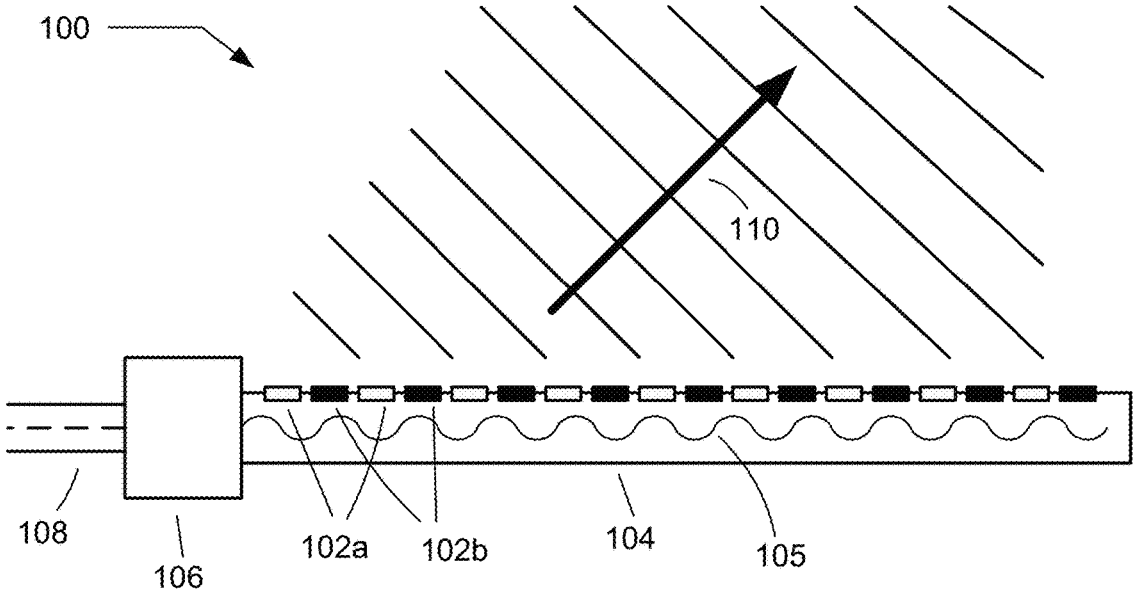
FIG. 1 is a schematic depiction of a surface scattering antenna.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

A schematic illustration of a surface scattering antenna is depicted in FIG. 1. The surface scattering antenna 100 includes a plurality of scattering elements 102*a*, 102*b* that are distributed along a wave-propagating structure 104. The wave propagating structure 104 may be a microstrip, a coplanar waveguide, a parallel plate waveguide, a dielectric slab, a closed or tubular waveguide, or any other structure capable of supporting the propagation of a guided wave or surface wave 105 along or within the structure. The wavy line 105 is a symbolic depiction of the guided wave or surface wave, and this symbolic depiction is not intended to indicate an actual wavelength or amplitude of the guided wave or surface wave; moreover, while the wavy line 105 is depicted as within the wave-propagating structure 104 (e.g. as for a guided wave in a metallic waveguide), for a surface wave the wave may be substantially localized outside the wave-propagating structure (e.g. as for a TM mode on a single wire transmission line or a "spoof plasmon" on an artificial impedance surface). The scattering elements 102*a*, 102*b* may include metamaterial elements that are embedded within, positioned on a surface of, or positioned within an evanescent proximity of, the wave-propagation structure 104; for example, the scattering elements can include complementary metamaterial elements such as those presented in D. R. Smith et al, "Metamaterials for surfaces and waveguides," U.S. Patent Application Publication No. 2010/0156573, which is herein incorporated by reference.

The surface scattering antenna also includes at least one feed connector 106 that is configured to couple the wave-propagation structure 104 to a feed structure 108. The feed structure 108 (schematically depicted as a coaxial cable)

may be a transmission line, a waveguide, or any other structure capable of providing an electromagnetic signal that may be launched, via the feed connector 106, into a guided wave or surface wave 105 of the wave-propagating structure 104. The feed connector 106 may be, for example, a coaxial-to-microstrip connector (e.g. an SMA-to-PCB adapter), a coaxial-to-waveguide connector, a mode-matched transition section, etc. While FIG. 1 depicts the feed connector in an "end-launch" configuration, whereby the guided wave or surface wave 105 may be launched from a peripheral region of the wave-propagating structure (e.g. from an end of a microstrip or from an edge of a parallel plate waveguide), in other embodiments the feed structure may be attached to a non-peripheral portion of the wave-propagating structure, whereby the guided wave or surface wave 105 may be launched from that non-peripheral portion of the wave-propagating structure (e.g. from a midpoint of a microstrip or through a hole drilled in a top or bottom plate of a parallel plate waveguide); and yet other embodiments may provide a plurality of feed connectors attached to the wave-propagating structure at a plurality of locations (peripheral and/or non-peripheral).

The scattering elements 102*a*, 102*b* are adjustable scattering elements having electromagnetic properties that are adjustable in response to one or more external inputs. Various embodiments of adjustable scattering elements are described, for example, in D. R. Smith et al, previously cited, and further in this disclosure. Adjustable scattering elements can include elements that are adjustable in response to voltage inputs (e.g. bias voltages for active elements (such as varactors, transistors, diodes) or for elements that incorporate tunable dielectric materials (such as ferroelectrics)), current inputs (e.g. direct injection of charge carriers into active elements), optical inputs (e.g. illumination of a photoactive material), field inputs (e.g. magnetic fields for elements that include nonlinear magnetic materials), mechanical inputs (e.g. MEMS, actuators, hydraulics), etc. In the schematic example of FIG. 1, scattering elements that have been adjusted to a first state having first electromagnetic properties are depicted as the first elements 102*a*, while scattering elements that have been adjusted to a second state having second electromagnetic properties are depicted as the second elements 102*b*. The depiction of scattering elements having first and second states corresponding to first and second electromagnetic properties is not intended to be limiting: embodiments may provide scattering elements that are discretely adjustable to select from a discrete plurality of states corresponding to a discrete plurality of different electromagnetic properties, or continuously adjustable to select from a continuum of states corresponding to a continuum of different electromagnetic properties. Moreover, the particular pattern of adjustment that is depicted in FIG. 1 (i.e. the alternating arrangement of elements 102*a* and 102*b*) is only an exemplary configuration and is not intended to be limiting.

In the example of FIG. 1, the scattering elements 102*a*, 102*b* have first and second couplings to the guided wave or surface wave 105 that are functions of the first and second electromagnetic properties, respectively. For example, the first and second couplings may be first and second polarizabilities of the scattering elements at the frequency or frequency band of the guided wave or surface wave. In one approach the first coupling is a substantially nonzero coupling whereas the second coupling is a substantially zero coupling. In another approach both couplings are substantially nonzero but the first coupling is substantially greater than (or less than) than the second coupling. On account of the first and second couplings, the first and second scattering elements 102*a*, 102*b* are responsive to the guided wave or surface wave 105 to produce a plurality of scattered electromagnetic waves having amplitudes that are functions of (e.g. are proportional to) the respective first and second couplings. A superposition of the scattered electromagnetic waves comprises an electromagnetic wave that is depicted, in this example, as a plane wave 110 that radiates from the surface scattering antenna 100.

The emergence of the plane wave may be understood by regarding the particular pattern of adjustment of the scattering elements (e.g. an alternating arrangement of the first and second scattering elements in FIG. 1) as a pattern that defines a grating that scatters the guided wave or surface wave 105 to produce the plane wave 110. Because this pattern is adjustable, some embodiments of the surface scattering antenna may provide adjustable gratings or, more generally, holograms, where the pattern of adjustment of the scattering elements may be selected according to principles of holography. Suppose, for example, that the guided wave or surface wave may be represented by a complex scalar input wave $\Psi_{in}$ that is a function of position along the wave-propagating structure 104, and it is desired that the surface scattering antenna produce an output wave that may be represented by another complex scalar wave $\Psi_{out}$. Then a pattern of adjustment of the scattering elements may be selected that corresponds to a an interference pattern of the input and output waves along the wave-propagating structure. For example, the scattering elements may be adjusted to provide couplings to the guided wave or surface wave that are functions of (e.g. are proportional to, or step-functions of) an interference term given by $\mathrm{Re}[\Psi_{out}\Psi^*_{in}]$. In this way, embodiments of the surface scattering antenna may be adjusted to provide arbitrary antenna radiation patterns by identifying an output wave $\Psi_{out}$ corresponding to a selected beam pattern, and then adjusting the scattering elements accordingly as above. Embodiments of the surface scattering antenna may therefore be adjusted to provide, for example, a selected beam direction (e.g. beam steering), a selected beam width or shape (e.g. a fan or pencil beam having a broad or narrow beamwidth), a selected arrangement of nulls (e.g. null steering), a selected arrangement of multiple beams, a selected polarization state (e.g. linear, circular, or elliptical polarization), a selected overall phase, or any combination thereof. Alternatively or additionally, embodiments of the surface scattering antenna may be adjusted to provide a selected near field radiation profile, e.g. to provide near-field focusing and/or near-field nulls.

Because the spatial resolution of the interference pattern is limited by the spatial resolution of the scattering elements, the scattering elements may be arranged along the wave-propagating structure with inter-element spacings that are much less than a free-space wavelength corresponding to an operating frequency of the device (for example, less than one-fourth of one-fifth of this free-space wavelength). In some approaches, the operating frequency is a microwave frequency, selected from frequency bands such as Ka, Ku, and Q, corresponding to centimeter-scale free-space wavelengths. This length scale admits the fabrication of scattering elements using conventional printed circuit board technologies, as described below.

Figure 2A:
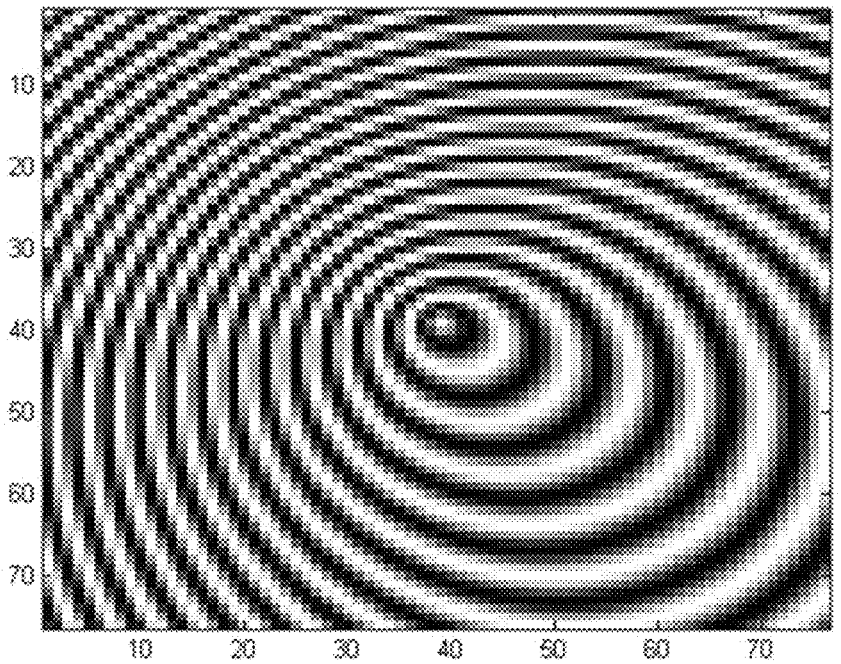
FIGS. 2A and 2B respectively depict an exemplary adjustment pattern and corresponding beam pattern for a surface scattering antenna.
Figure 2B:
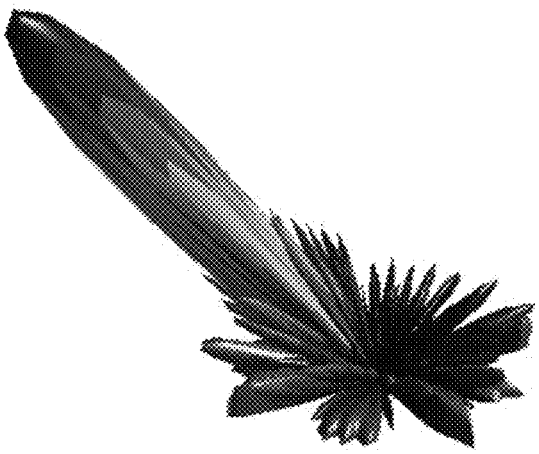
Figure 3A:
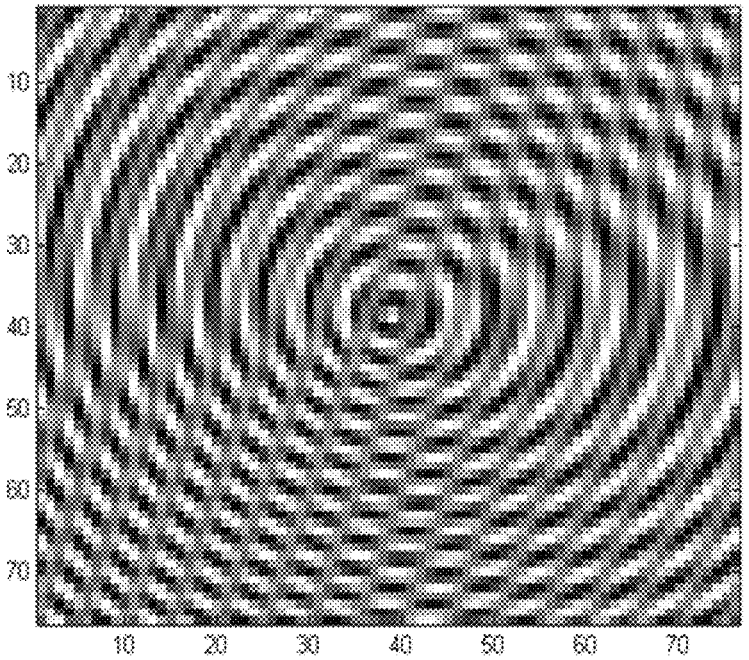
FIGS. 3A and 3B respectively depict another exemplary adjustment pattern and corresponding beam pattern for a surface scattering antenna.
Figure 3B:
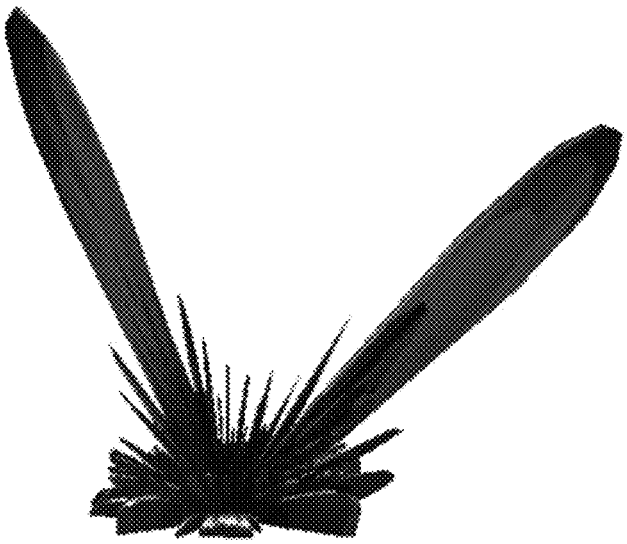
Figure 4A:
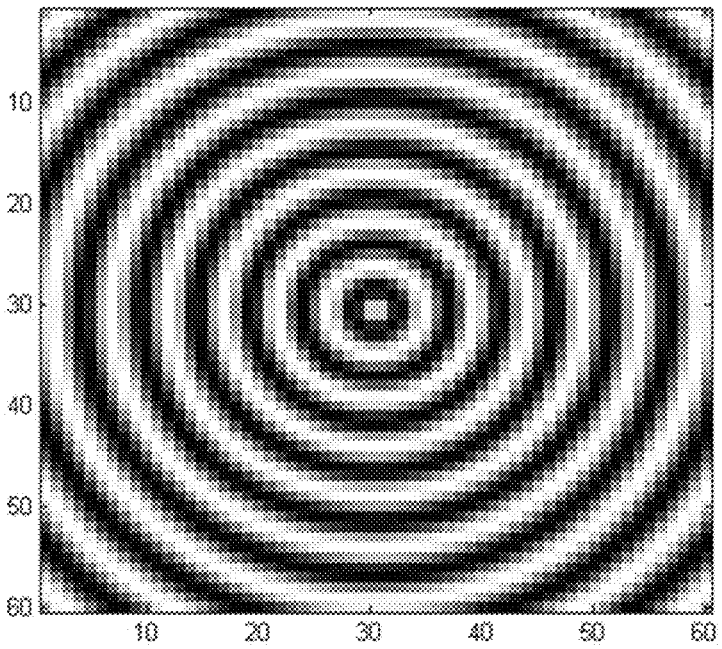
FIGS. 4A and 4B respectively depict another exemplary adjustment pattern and corresponding field pattern for a surface scattering antenna.
Figure 4B:
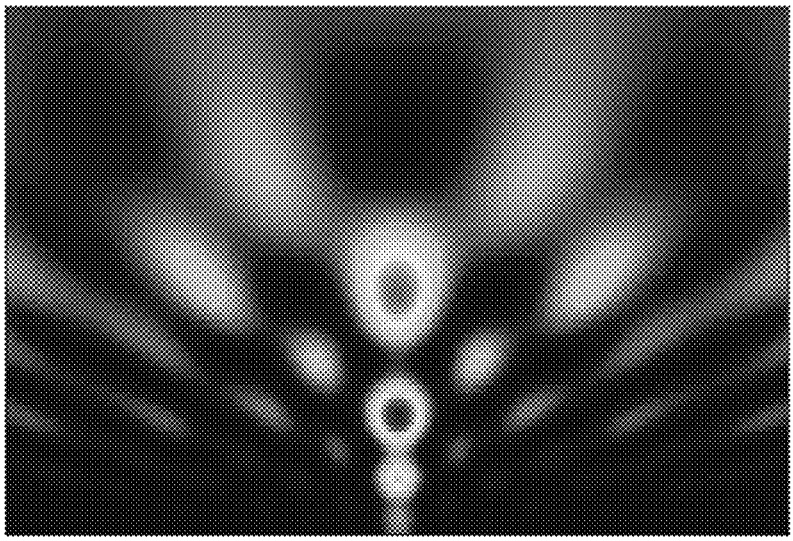

In some approaches, the surface scattering antenna includes a substantially one-dimensional wave-propagating structure 104 having a substantially one-dimensional arrangement of scattering elements, and the pattern of adjustment of this one-dimensional arrangement may provide, for example, a selected antenna radiation profile as a function of zenith angle (i.e. relative to a zenith direction that is parallel to the one-dimensional wave-propagating structure). In other approaches, the surface scattering antenna includes a substantially two-dimensional wave-propagating structure 104 having a substantially two-dimensional arrangement of scattering elements, and the pattern of adjustment of this two-dimensional arrangement may provide, for example, a selected antenna radiation profile as a function of both zenith and azimuth angles (i.e. relative to a zenith direction that is perpendicular to the two-dimensional wave-propagating structure). Exemplary adjustment patterns and beam patterns for a surface scattering antenna that includes a two-dimensional array of scattering elements distributed on a planar rectangular wave-propagating structure are depicted in FIGS. 2A-4B. In these exemplary embodiments, the planar rectangular wave-propagating structure includes a monopole antenna feed that is positioned at the geometric center of the structure. FIG. 2A presents an adjustment pattern that corresponds to a narrow beam having a selected zenith and azimuth as depicted by the beam pattern diagram of FIG. 2B. FIG. 3A presents an adjustment pattern that corresponds to a dual-beam far field pattern as depicted by the beam pattern diagram of FIG. 3B. FIG. 4A presents an adjustment pattern that provides near-field focusing as depicted by the field intensity map of FIG. 4B (which depicts the field intensity along a plane perpendicular to and bisecting the long dimension of the rectangular wave-propagating structure).

In some approaches, the wave-propagating structure is a modular wave-propagating structure and a plurality of modular wave-propagating structures may be assembled to compose a modular surface scattering antenna. For example, a plurality of substantially one-dimensional wave-propagating structures may be arranged, for example, in an interdigital fashion to produce an effective two-dimensional arrangement of scattering elements. The interdigital arrangement may comprise, for example, a series of adjacent linear structures (i.e. a set of parallel straight lines) or a series of adjacent curved structures (i.e. a set of successively offset curves such as sinusoids) that substantially fills a two-dimensional surface area. As another example, a plurality of substantially two-dimensional wave-propagating structures (each of which may itself comprise a series of one-dimensional structures, as above) may be assembled to produce a larger aperture having a larger number of scattering elements; and/or the plurality of substantially two-dimensional wave-propagating structures may be assembled as a three-dimensional structure (e.g. forming an A-frame structure, a pyramidal structure, or other multi-faceted structure). In these modular assemblies, each of the plurality of modular wave-propagating structures may have its own feed connector(s) 106, and/or the modular wave-propagating structures may be configured to couple a guided wave or surface wave of a first modular wave-propagating structure into a guided wave or surface wave of a second modular wave-propagating structure by virtue of a connection between the two structures.

In some applications of the modular approach, the number of modules to be assembled may be selected to achieve an aperture size providing a desired telecommunications data capacity and/or quality of service, and/or a three-dimensional arrangement of the modules may be selected to reduce potential scan loss. Thus, for example, the modular assembly could comprise several modules mounted at various locations/orientations flush to the surface of a vehicle such as an aircraft, spacecraft, watercraft, ground vehicle, etc. (the modules need not be contiguous). In these and other approaches, the wave-propagating structure may have a substantially non-linear or substantially non-planar shape whereby to conform to a particular geometry, therefore providing a conformal surface scattering antenna (conforming, for example, to the curved surface of a vehicle).

More generally, a surface scattering antenna is a reconfigurable antenna that may be reconfigured by selecting a pattern of adjustment of the scattering elements so that a corresponding scattering of the guided wave or surface wave produces a desired output wave. Suppose, for example, that the surface scattering antenna includes a plurality of scattering elements distributed at positions $\{r_j\}$ along a wave-propagating structure 104 as in FIG. 1 (or along multiple wave-propagating structures, for a modular embodiment) and having a respective plurality of adjustable couplings $\{\alpha_j\}$ to the guided wave or surface wave 105. The guided wave or surface wave 105, as it propagates along or within the (one or more) wave-propagating structure(s), presents a wave amplitude $A_j$ and phase $\varphi_j$ to the jth scattering element; subsequently, an output wave is generated as a superposition of waves scattered from the plurality of scattering elements:

$$E(\theta, \phi) = \sum_j R_j(\theta, \phi)\alpha_j A_j e^{i\varphi_j} e^{i(k(\theta,\phi)\cdot r_j)}, \tag{4}$$

where $E(\theta,\phi)$ represents the electric field component of the output wave on a far-field radiation sphere, $R_j(\theta,\phi)$ represents a (normalized) electric field pattern for the scattered wave that is generated by the jth scattering element in response to an excitation caused by the coupling $\alpha_j$, and $k(\theta,\phi)$ represents a wave vector of magnitude $\omega/c$ that is perpendicular to the radiation sphere at $(\theta,\phi)$. Thus, embodiments of the surface scattering antenna may provide a reconfigurable antenna that is adjustable to produce a desired output wave $E(\theta,\phi)$ by adjusting the plurality of couplings $\{\alpha_j\}$ in accordance with equation (1).

The wave amplitude $A_j$ and phase $\varphi_j$ of the guided wave or surface wave are functions of the propagation characteristics of the wave-propagating structure 104. These propagation characteristics may include, for example, an effective refractive index and/or an effective wave impedance, and these effective electromagnetic properties may be at least partially determined by the arrangement and adjustment of the scattering elements along the wave-propagating structure. In other words, the wave-propagating structure, in combination with the adjustable scattering elements, may provide an adjustable effective medium for propagation of the guided wave or surface wave, e.g. as described in D. R. Smith et al, previously cited. Therefore, although the wave amplitude $A_j$ and phase $\varphi_j$ of the guided wave or surface wave may depend upon the adjustable scattering element couplings $\{\alpha_j\}$ (i.e. $A_i=A_i(\{\alpha_j\})$, $\varphi_i=\varphi_i(\{\alpha_j\})$), in some embodiments these dependencies may be substantially predicted according to an effective medium description of the wave-propagating structure.

In some approaches, the reconfigurable antenna is adjustable to provide a desired polarization state of the output wave $E(\theta,\phi)$. Suppose, for example, that first and second subsets $LP^{(1)}$ and $LP^{(2)}$ of the scattering elements provide (normalized) electric field patterns $R^{(1)}(\theta,\phi)$ and $R^{(2)}(\theta,\phi)$, respectively, that are substantially linearly polarized and substantially orthogonal (for example, the first and second subjects may be scattering elements that are perpendicularly oriented on a surface of the wave-propagating structure 104). Then the antenna output wave $E(\theta,\phi)$ may be expressed as a sum of two linearly polarized components:

$$E(\theta,\phi)=E^{(1)}(\theta,\phi)+E^{(2)}(\theta,\phi)=\Lambda^{(1)}R^{(1)}(\theta,\phi)+\Lambda^{(2)}R^{(2)}(\theta,\phi), \quad (5)$$

where $$\Lambda^{(1,2)}(\theta,\phi)=\sum_{j\in LP^{(1,2)}}\alpha_j A_j e^{i\varphi_j} e^{i(k(\theta,\phi)\cdot r_j)}, \quad (6)$$

are the complex amplitudes of the two linearly polarized components. Accordingly, the polarization of the output wave $E(\theta,\phi)$ may be controlled by adjusting the plurality of couplings $\{\alpha_j\}$ in accordance with equations (2)-(3), e.g. to provide an output wave with any desired polarization (e.g. linear, circular, or elliptical).

Alternatively or additionally, for embodiments in which the wave-propagating structure has a plurality of feeds (e.g. one feed for each "finger" of an interdigital arrangement of one-dimensional wave-propagating structures, as discussed above), a desired output wave $E(\theta,\phi)$ may be controlled by adjusting gains of individual amplifiers for the plurality of feeds. Adjusting a gain for a particular feed line would correspond to multiplying the $A_j$'s by a gain factor G for those elements j that are fed by the particular feed line. Especially, for approaches in which a first wave-propagating structure having a first feed (or a first set of such structures/feeds) is coupled to elements that are selected from $LP^{(1)}$ and a second wave-propagating structure having a second feed (or a second set of such structures/feeds) is coupled to elements that are selected from $LP^{(2)}$, depolarization loss (e.g., as a beam is scanned off-broadside) may be compensated by adjusting the relative gain(s) between the first feed(s) and the second feed(s).

Figure 5:
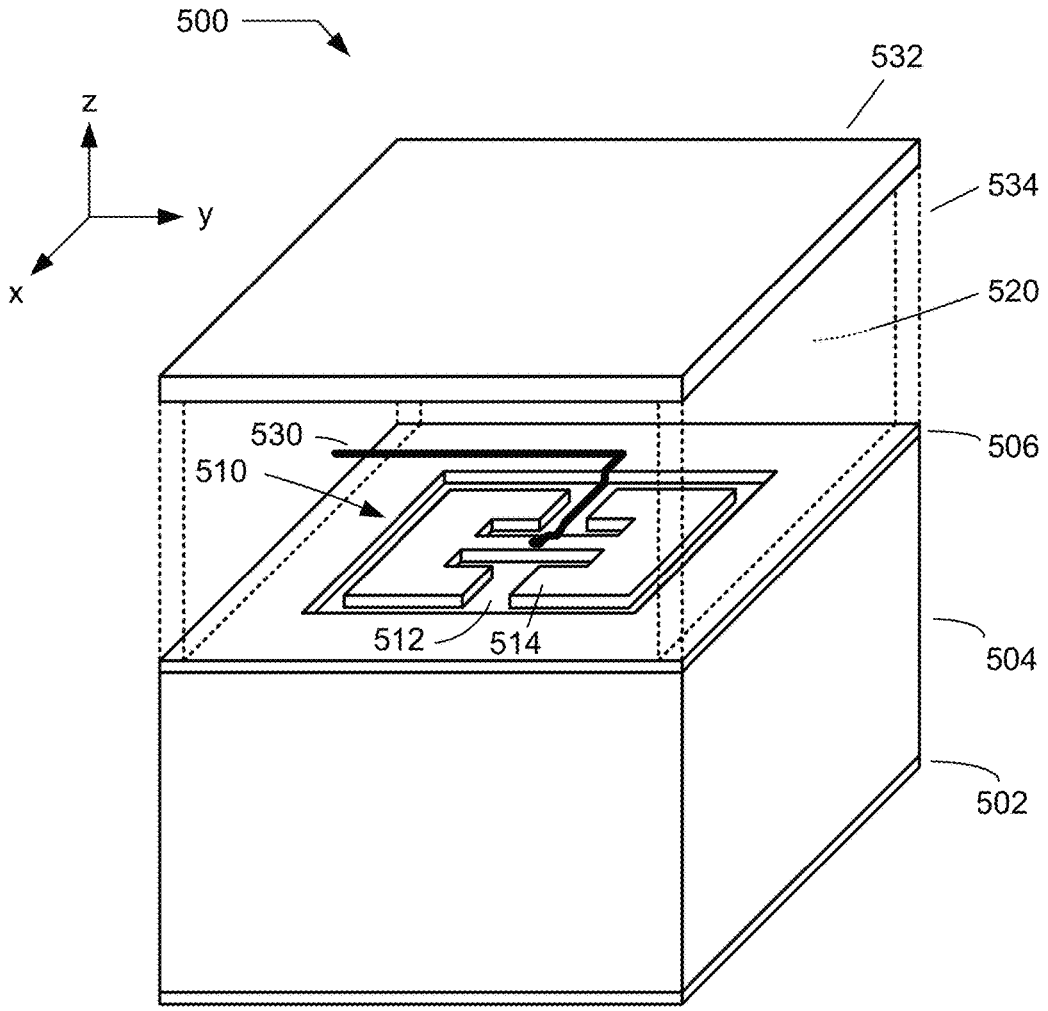
FIGS. 5 and 6 depict a unit cell of a surface scattering antenna.

As mentioned previously in the context of FIG. 1, in some approaches the surface scattering antenna 100 includes a wave-propagating structure 104 that may be implemented as a microstrip or a parallel plate waveguide (or a plurality of such elements); and in these approaches, the scattering elements may include complementary metamaterial elements such as those presented in D. R. Smith et at, previously cited. Turning now to FIG. 5, an exemplary unit cell 500 of a microstrip or parallel-plate waveguide is depicted that includes a lower conductor or ground plane 502 (made of copper or similar material), a dielectric substrate 504 (made of Duriod, FR4, or similar material), and an upper conductor 506 (made of copper or similar material) that embeds a complementary metamaterial element 510, in this case a complementary electric LC (CELC) metamaterial element that is defined by a shaped aperture 512 that has been etched or patterned in the upper conductor (e.g. by a PCB process).

A CELC element such as that depicted in FIG. 5 is substantially responsive to a magnetic field that is applied parallel to the plane of the CELC element and perpendicular to the CELC gap complement, i.e. in the $\hat{x}$ direction for the for the orientation of FIG. 5 (cf. T. H. Hand et al, "Characterization of complementary electric field coupled resonant surfaces," *Applied Physics Letters* 93, 212504(2008), herein incorporated by reference). Therefore, a magnetic field component of a guided wave that propagates in the microstrip or parallel plate waveguide (being an instantiation of the guided wave or surface wave 105 of FIG. 1) can induce a magnetic excitation of the element 510 that may be substantially characterized as a magnetic dipole excitation oriented in $\hat{x}$ direction, thus producing a scattered electromagnetic wave that is substantially a magnetic dipole radiation field.

Noting that the shaped aperture 512 also defines a conductor island 514 which is electrically disconnected from the upper conductor 506, in some approaches the scattering element can be made adjustable by providing an adjustable material within and/or proximate to the shaped aperture 512 and subsequently applying a bias voltage between the conductor island 514 and the upper conductor 506. For example, as shown in FIG. 5, the unit cell may be immersed in a layer of liquid crystal material 520. Liquid crystals have a permittivity that is a function of orientation of the molecules comprising the liquid crystal; and that orientation may be controlled by applying a bias voltage (equivalently, a bias electric field) across the liquid crystal; accordingly, liquid crystals can provide a voltage-tunable permittivity for adjustment of the electromagnetic properties of the scattering element.

The liquid crystal material 520 may be retained in proximity to the scattering elements by, for example, providing a liquid crystal containment structure on the upper surface of the wave-propagating structure. An exemplary configuration of a liquid crystal containment structure is shown in FIG. 5, which depicts a liquid crystal containment structure that includes a covering portion 532 and, optionally, one or more support portions or spacers 534 that provide a separation between the upper conductor 506 and the covering portion 532. In some approaches, the liquid crystal containment structure is a machined or injection-molded plastic part having a flat surface that may be joined to the upper surface of the wave-propagating structure, the flat surface including one or more indentations (e.g. grooves or recesses) that may be overlaid on the scattering elements; and these indentations may be filled with liquid crystal by, for example, a vacuum injection process. In other approaches, the support portions 534 are spherical spacers (e.g. spherical resin particles); or walls or pillars that are formed by a photolithographic process (e.g. as described in Sato et al, "Method for manufacturing liquid crystal device with spacers formed by photolithography," U.S. Pat. No. 4,874,461, herein incorporated by reference); the covering portion 532 is then affixed to the support portions 534, followed by installation (e.g. by vacuum injection) of the liquid crystal.

For a nematic phase liquid crystal, wherein the molecular orientation may be characterized by a director field, the material may provide a larger permittivity $\varepsilon_{\parallel}$ for an electric field component that is parallel to the director and a smaller permittivity $\varepsilon_{\perp}$ for an electric field component that is perpendicular to the director. Applying a bias voltage introduces bias electric field lines that span the shaped aperture and the director tends to align parallel to these electric field lines (with the degree of alignment increasing with bias voltage). Because these bias electric field lines are substantially parallel to the electric field lines that are produced during a scattering excitation of the scattering element, the permittivity that is seen by the biased scattering element correspondingly tends towards $\varepsilon_{\parallel}$ (i.e. with increasing bias voltage). On the other hand, the permittivity that is seen by the unbiased scattering element may depend on the unbiased configuration of the liquid crystal. When the unbiased liquid crystal is maximally disordered (i.e. with randomly oriented micro-domains), the unbiased scattering element may see an averaged permittivity $\varepsilon_{ave}\sim(\varepsilon_{\parallel}+\varepsilon_{\perp})/2$. When the unbiased liquid crystal is maximally aligned perpendicular to the bias electric field lines (i.e. prior to the application of the bias electric field), the unbiased scattering element may see a permittivity as small as $\varepsilon_{\perp}$. Accordingly, for embodiments where it is desired to achieve a greater range of tuning of the permittivity that is seen by the scattering element (corresponding to a greater range of tuning of an effective capacitance of the scattering element and therefore a greater range of tuning of a resonant frequency of the scattering element), the unit cell 500 may include positionally-dependent alignment layer(s) disposed at the top and/or bottom surface of the liquid crystal layer 510, the positionally-dependent alignment layer(s) being configured to align the liquid crystal director in a direction substantially perpendicular to the bias electric field lines that correspond an applied bias voltage. The alignment layer(s) may include, for example, polyimide layer(s) that are rubbed or otherwise patterned (e.g. by machining or photolithography) to introduce microscopic grooves that run parallel to the channels of the shaped aperture 512.

Alternatively or additionally, the unit cell may provide a first biasing that aligns the liquid crystal substantially perpendicular to the channels of the shaped aperture 512 (e.g. by introducing a bias voltage between the upper conductor 506 and the conductor island 514, as described above), and a second biasing that aligns the liquid crystal substantially parallel to the channels of the shaped aperture 512 (e.g. by introducing electrodes positioned above the upper conductor 506 at the four corners of the units cell, and applying opposite voltages to the electrodes at adjacent corners); tuning of the scattering element may then be accomplished by, for example, alternating between the first biasing and the second biasing, or adjusting the relative strengths of the first and second biasings.

Figure 6:
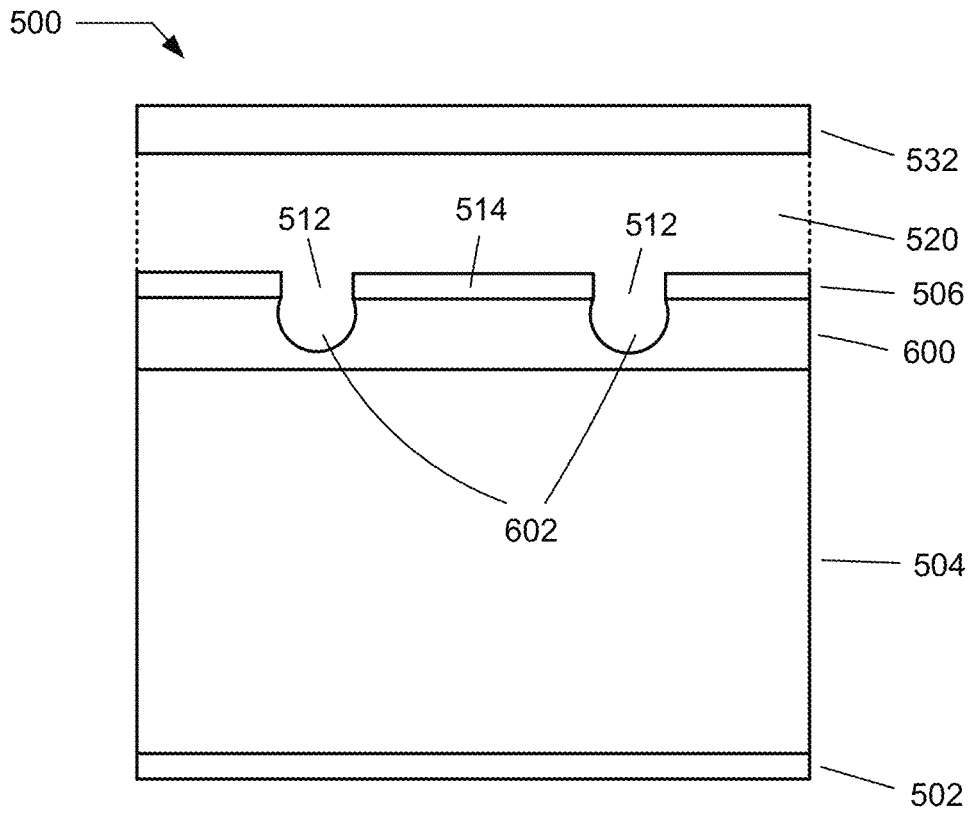

In some approaches, a sacrificial layer may be used to enhance the effect of the liquid crystal tuning by admitting a greater volume of liquid crystal within a vicinity of the shaped aperture 512. An illustration of this approach is depicted in FIG. 6, which shows the unit cell 500 of FIG. 5 in profile, with the addition of a sacrificial layer 600 (e.g. a polyimide layer) that is deposited between the dielectric substrate 504 and the upper conductor 506. Subsequent to etching of the upper conductor 506 to define the shaped aperture 512, a further selective etching of the sacrificial layer 600 produces cavities 602 that may then be filled with the liquid crystal 520. In some approaches another masking layer is used (instead of or in addition to making by the upper conductor 506) to define the pattern of selective etching of the sacrificial layer 600.

Exemplary liquid crystals that may be deployed in various embodiments include 4-Cyano-4'-pentylbiphenyl, high birefringence eutectic LC mixtures such as LCMS-107 (LC Matter) or GT3-23001 (Merck). Some approaches may utilize dual-frequency liquid crystals. In dual-frequency liquid crystals, the director aligns substantially parallel to an applied bias field at a lower frequencies, but substantially perpendicular to an applied bias field at higher frequencies. Accordingly, for approaches that deploy these dual-frequency liquid crystals, tuning of the scattering elements may be accomplished by adjusting the frequency of the applied bias voltage signals. Other approaches may deploy polymer network liquid crystals (PNLCs) or polymer dispersed liquid crystals (PDLCs), which generally provide much shorter relaxation/switching times for the liquid crystal. An example of the former is a thermal or UV cured mixture of a polymer (such as BPA-dimethacrylate) in a nematic LC host (such as LCMS-107); cf. Y. H. Fan et al, "Fast-response and scattering-free polymer network liquid crystals for infrared light modulators," *Applied Physics Letters* 84, 1233-35 (2004), herein incorporated by reference. An example of the latter is a porous polymer material (such as a PTFE membrane) impregnated with a nematic LC (such as LCMS-107); cf. T. Kuki et al, "Microwave variable delay line using a membrane impregnated with liquid crystal," *Microwave Symposium Digest,* 2002 *IEEE MTT-S International*, vol. 1, pp. 363-366 (2002), herein incorporated by reference.

Turning now to approaches for providing a bias voltage between the conductor island 514 and the upper conductor 506, it is first noted that the upper conductor 506 extends contiguously from one unit cell to the next, so an electrical connection to the upper conductor of every unit cell may be made by a single connection to the upper conductor of the microstrip or parallel-plate waveguide of which unit cell 500 is a constituent. As for the conductor island 514, FIG. 5 shows an example of how a bias voltage line 530 may be attached to the conductor island. In this example, the bias voltage line 530 is attached at the center of the conductor island and extends away from the conductor island along an plane of symmetry of the scattering element; by virtue of this positioning along a plane of symmetry, electric fields that are experienced by the bias voltage line during a scattering excitation of the scattering element are substantially perpendicular to the bias voltage line and therefore do not excite currents in the bias voltage line that could disrupt or alter the scattering properties of the scattering element. The bias voltage line 530 may be installed in the unit cell by, for example, depositing an insulating layer (e.g. polyimide), etching the insulating layer at the center of the conductor island 514, and then using a lift-off process to pattern a conducting film (e.g. a Cr/Au bilayer) that defines the bias voltage line 530.

Figure 7A:
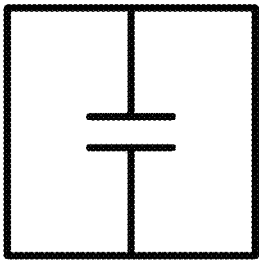
FIGS. 7A-7H depict examples of metamaterial elements.
Figure 7A:
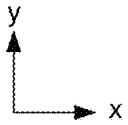
Figure 7B:
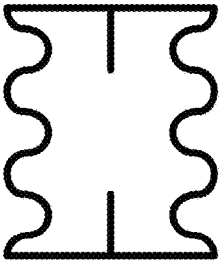
Figure 7C:
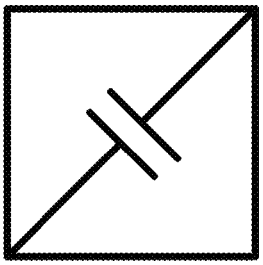
Figure 7D:
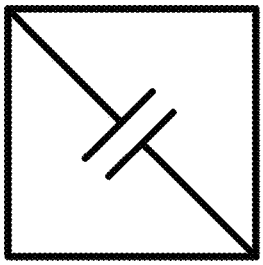
Figure 7E:
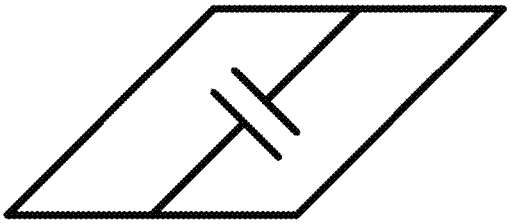
Figure 7F:
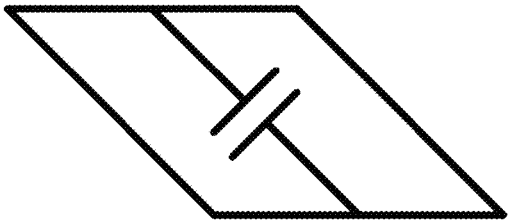
Figure 7G:
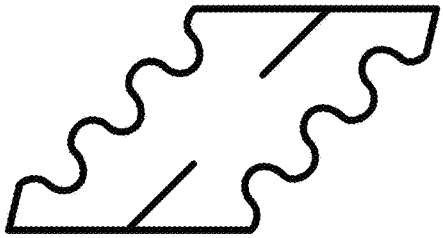
Figure 7H:
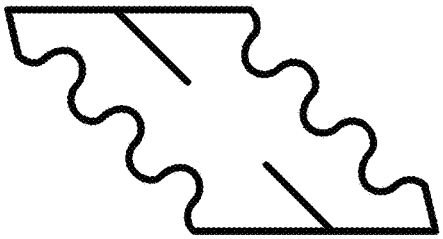

FIGS. 7A-7H depict a variety of CELC elements that may be used in accordance with various embodiments of a surface scattering antenna. These are schematic depictions of exemplary elements, not drawn to scale, and intended to be merely representative of a broad variety of possible CELC elements suitable for various embodiments. FIG. 7A corresponds to the element used in FIG. 5. FIG. 7B depicts an alternative CELC element that is topologically equivalent to that of 7A, but which uses an undulating perimeter to increase the lengths of the arms of the element, thereby increasing the capacitance of the element. FIGS. 7C and 7D depict a pair of element types that may be utilized to provide polarization control. When these orthogonal elements are excited by a guided wave or surface wave having a magnetic field oriented in the $\hat{y}$ direction, this applied magnetic field produces magnetic excitations that may be substantially characterized as magnetic dipole excitations, oriented at +45° or −45° relative to the $\hat{x}$ direction for the element of 7C or 7D, respectively. FIGS. 7E and 7F depict variants of such orthogonal CELC elements in the which the arms of the CELC element are also slanted at a ±45° angle. These slanted designs potentially provide a purer magnetic dipole response, because all of the regions of the CELC element that give rise to the dipolar response are either oriented orthogonal to the exciting field (and therefore not excited) or at a 45° angle with respect to that field. Finally, FIGS. 7E and 7F depict similarly slanted variants of the undulated CELC element of FIG. 7B.

Figure 8:
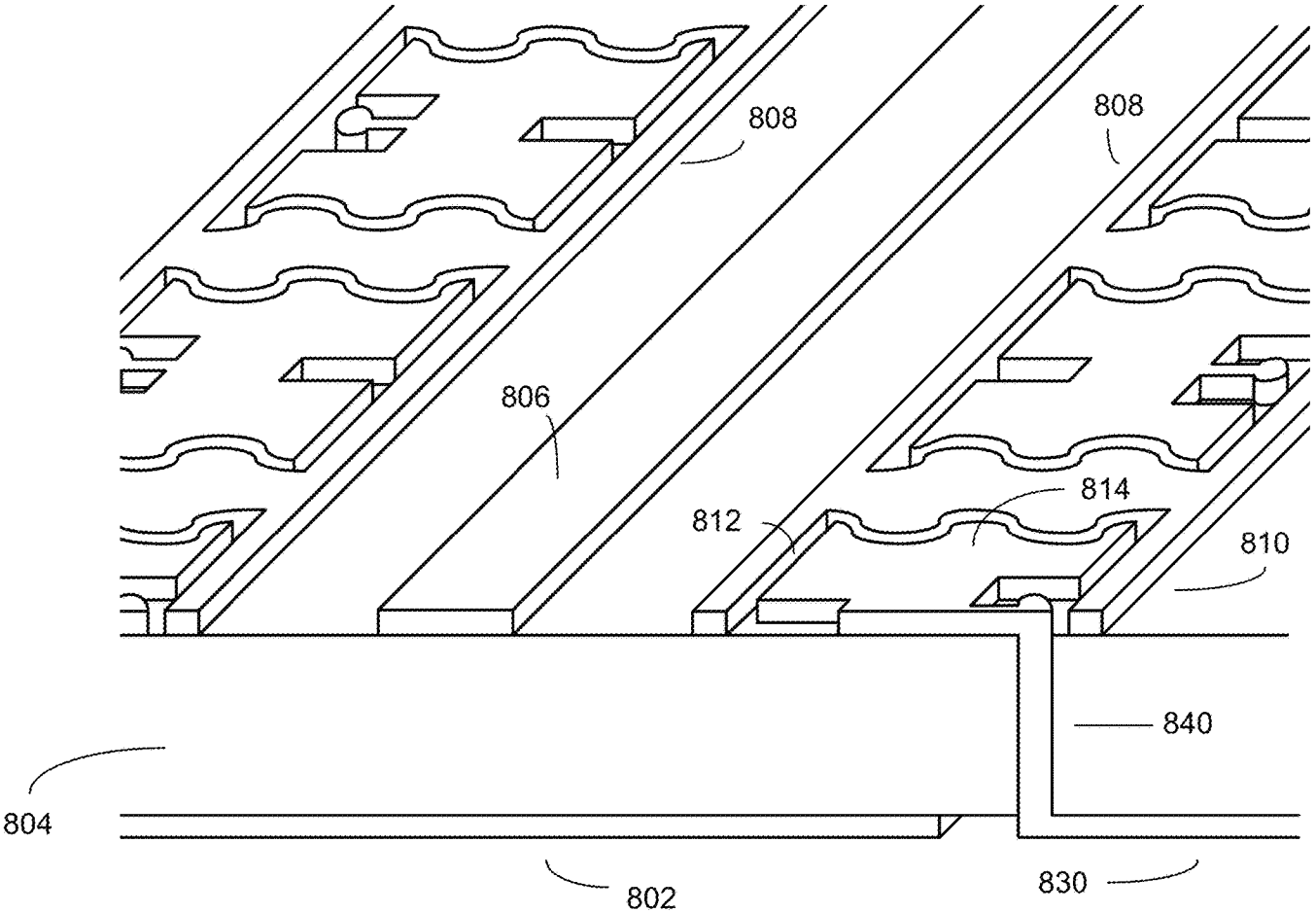
FIG. 8 depicts a microstrip embodiment of a surface scattering antenna.

While FIG. 5 presents an example of a metamaterial element 510 that is patterned on the upper conductor 506 of a wave-propagating structure such as a microstrip, in another approach, as depicted in FIG. 8, the metamaterial elements are not positioned on the microstrip itself; rather, they are positioned within an evanescent proximity of (i.e. within the fringing fields of) a microstrip. Thus, FIG. 8 depicts a microstrip configuration having a ground plane 802, a dielectric substrate 804, and an upper conductor 806, with conducting strips 808 positioned along either side of the microstrip. These conducting strips 808 embed complementary metamaterial elements 810 defined by shaped apertures 812. In this example, the complementary metamaterial elements are undulating-perimeter CELC elements such as that shown in FIG. 7B. As shown in FIG. 8, a via 840 can be used to connect a bias voltage line 830 to the conducting island 814 of each metamaterial element. As a result, this configuration can be readily implemented using a two-layer PCB process (two conducting layers with an intervening dielectric), with layer 1 providing the microstrip signal trace and metamaterial elements, and layer 2 providing the microstrip ground plane and biasing traces. The dielectric and conducting layers may be high efficiency materials such as copper-clad Rogers 5880. As before, tuning may be accomplished by disposing a layer of liquid crystal (not shown) above the metamaterial elements 810.

Figure 9A:
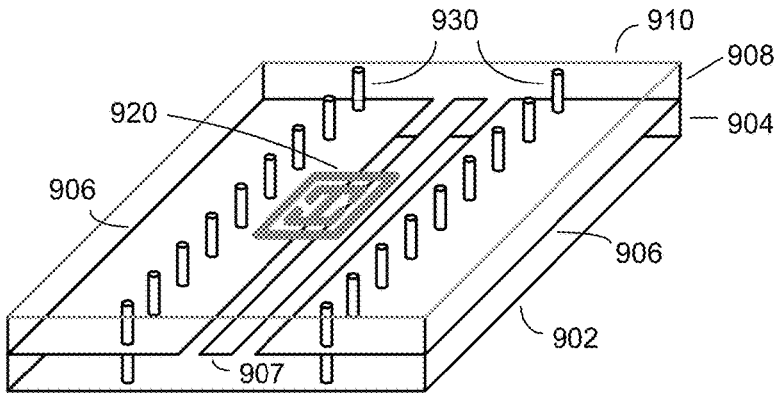
FIGS. 9A and 9B depict a coplanar waveguide embodiment of a surface scattering antenna.
Figure 9B:
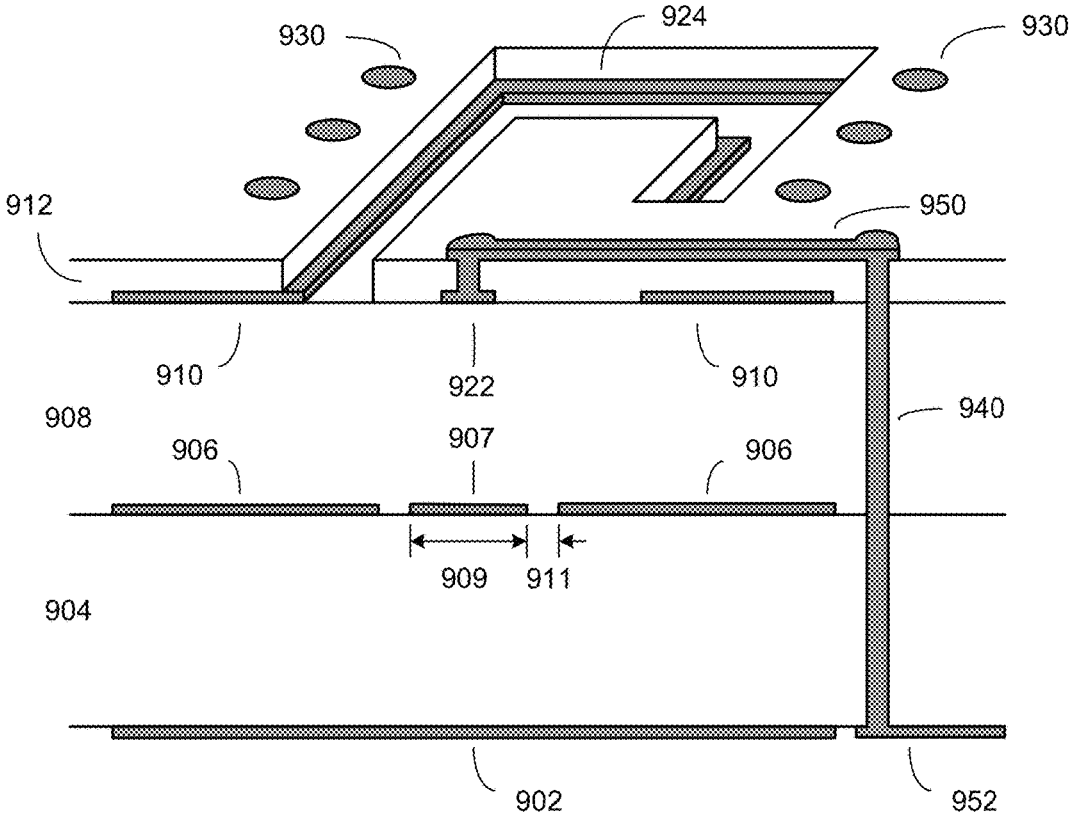

In yet another approach, as depicted in FIGS. 9A and 9B, the wave-propagating structure is a coplanar waveguide (CPW), and the metamaterial elements are positioned within an evanescent proximity of (i.e. within the fringing fields of) the coplanar waveguide. Thus, FIGS. 9A and 9B depict a coplanar waveguide configuration having a lower ground plane 902, central ground planes 906 on either side of a CPW signal trace 907, and an upper ground plane 910 that embeds complementary metamaterial elements 920 (only one is shown, but the approach positions a series of such elements along the length of the CPW). These successive conducting layers are separated by dielectric layers 904, 908. The coplanar waveguide may be bounded by colonnades of vias 930 that can serve to cut off higher order modes of the CPW and/or reduce crosstalk with adjacent CPWs (not shown). The CPW strip width 909 can be varied along the length of the CPW to control the couplings to the metamaterial elements 920, e.g. to enhance aperture efficiency and/or control aperture tapering of the beam profile. The CPW gap width 911 can be adjusted the control the line impedance. As shown in FIG. 9B, a third dielectric layer 912 and a through-via 940 can be used to connect a bias voltage line 950 to the conducting island 922 of each metamaterial element and to a biasing pad 952 situated on the underside of the structure. Channels 924 in the third dielectric layer 912 admit the disposal of the liquid crystal (not shown) within the vicinities of the shaped apertures of the conducting element. This configuration can be implemented using a four-layer PCB process (four conducting layers with three intervening dielectric layers). These PCBs may be manufactured using lamination stages along with through, blind and buried via formation as well as electroplating and electroless plating techniques.

Figure 10:
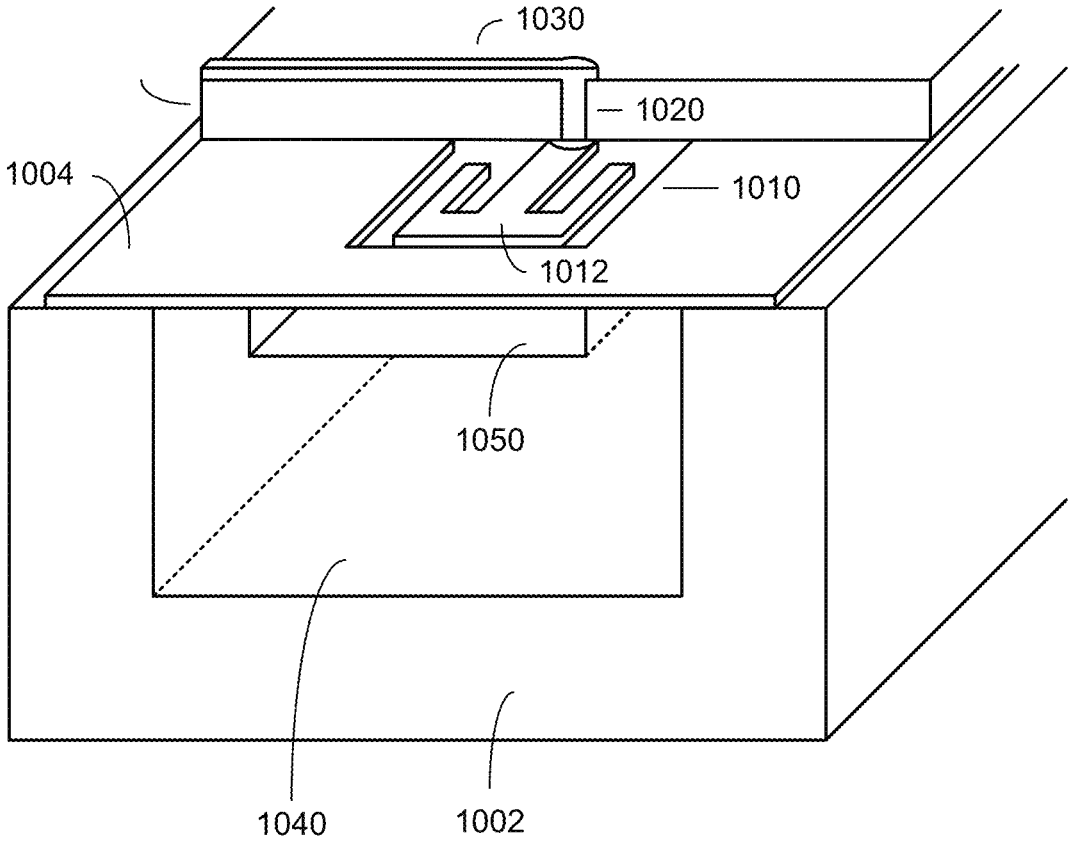
FIGS. 10 and 11 depict a closed waveguide embodiments of a surface scattering antenna.
Figure 11:
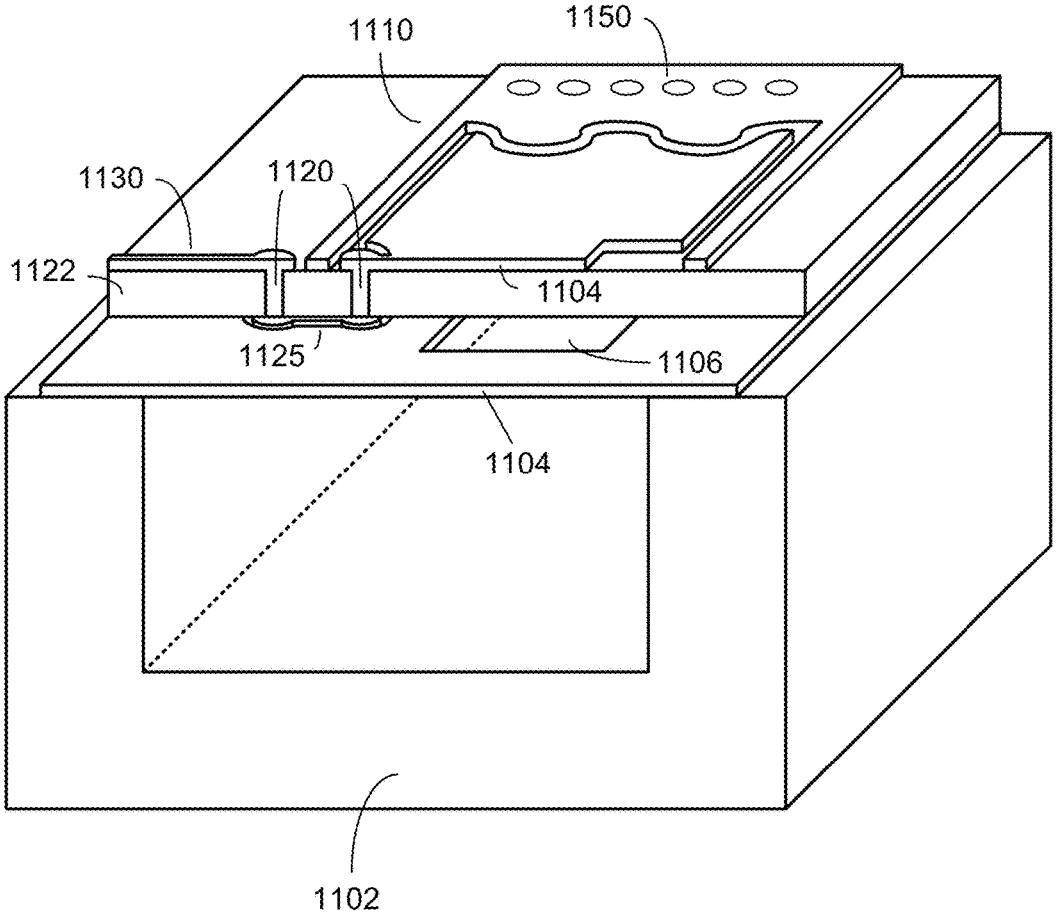

In still another approach, depicted in FIGS. 10 and 11, the wave-propagating structure is a closed, or tubular, waveguide, and the metamaterial elements are positioned along the surface of the closed waveguide. Thus, FIG. 10 depicts a closed, or tubular, waveguide with a rectangular cross section defined by a trough 1002 and a conducting surface 1004 that embeds the metamaterial element 1010. As the cutaway shows, a via 1020 through a dielectric layer 1022 can be used to connect a bias voltage line 1030 to the conducting island 1012 of the metamaterial element. The trough 1002 can be implemented as a piece of metal that is milled or cast to provide the "floor and walls" of the closed waveguide, and the waveguide "ceiling" can be implemented as a two-layer printed circuit board, with the top layer providing the biasing traces 1030 and the bottom layer providing the metamaterial elements 1010. The waveguide may be loaded with a dielectric 1040 (such as PTFE) having a smaller trough 1050 that can be filled with liquid crystal to admit tuning of the metamaterial elements.

In an alternative closed waveguide embodiment as depicted in FIG. 11, a closed waveguide with a rectangular cross section is defined by a trough 1102 and conducting surface 1104. As the unit cell cutaway shows, the conductor surface 1104 has an iris 1106 that admits coupling between a guided wave and the resonator element 1110. In this example, the complementary metamaterial element is an undulating-perimeter CELC element such as that shown in FIG. 7B. While the figure depicts a rectangular coupling iris, other shapes can be used, and the dimensions of the irises may be varied along the length of the waveguide to control the couplings to the scattering elements (e.g. to enhance aperture efficiency and/or control aperture tapering of the beam profile). A pair of vias 1120 through the dielectric layer 1122 can be used together with a short routing line 1125 to connect a bias voltage line 1130 to the conducting island 1112 of the metamaterial element. The trough 1102 can be implemented as a piece of metal that is milled or cast to provide the "floor and walls" of the closed waveguide, and the waveguide "ceiling" can be implemented as a two-layer printed circuit board, with the top layer providing the metamaterial elements 1110 (and biasing traces 1130), and the bottom layer providing the irises 1106 (and biasing routings 1125). The metamaterial element 1110 may be optionally bounded by colonnades of vias 1150 extending through the dielectric layer 1122 to reduce coupling or crosstalk between adjacent unit cells. As before, tuning may be accomplished by disposing a layer of liquid crystal (not shown) above the metamaterial elements 1110.

While the waveguide embodiments of FIGS. 10 and 11 provide waveguides having a simple rectangular cross section, in some approaches the waveguide may include one or more ridges (as in a double-ridged waveguide). Ridged waveguides can provide greater bandwidth than simple rectangular waveguides and the ridge geometries (widths/heights) can be varied along the length of the waveguide to control the couplings to the scattering elements (e.g. to enhance aperture efficiency and/or control aperture tapering of the beam profile) and/or to provide a smooth impedance transition (e.g. from an SMA connector feed).

Figure 12:
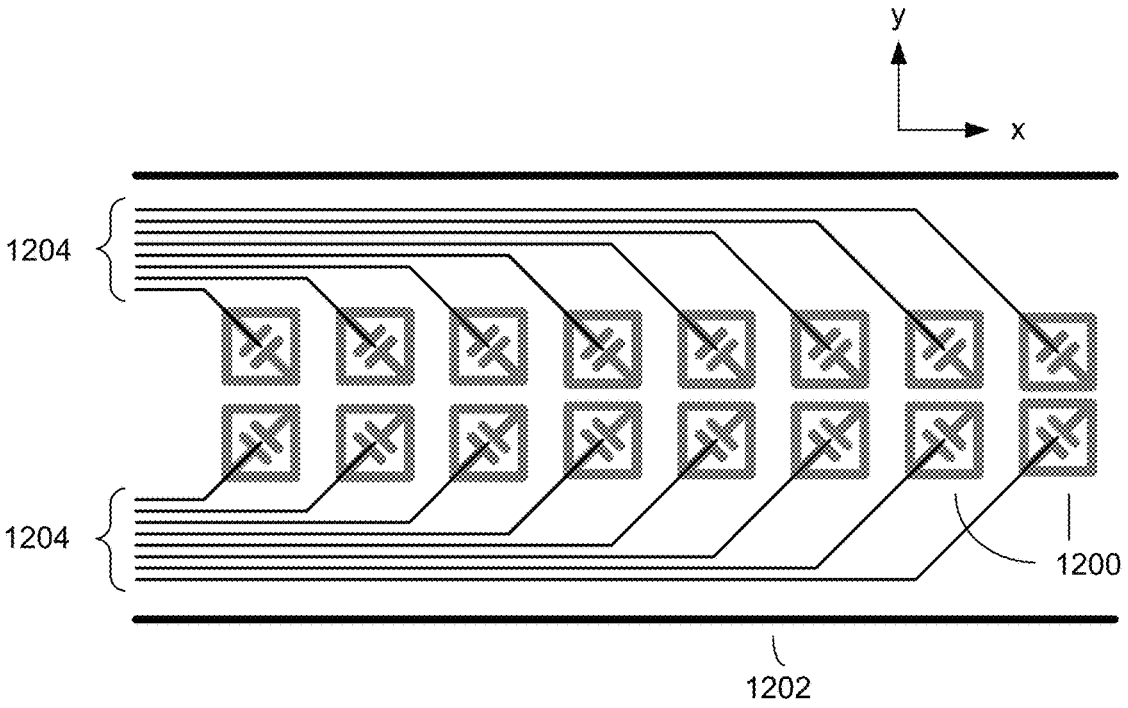
FIG. 12 depicts a surface scattering antenna with direct addressing of the scattering elements.
Figure 13:
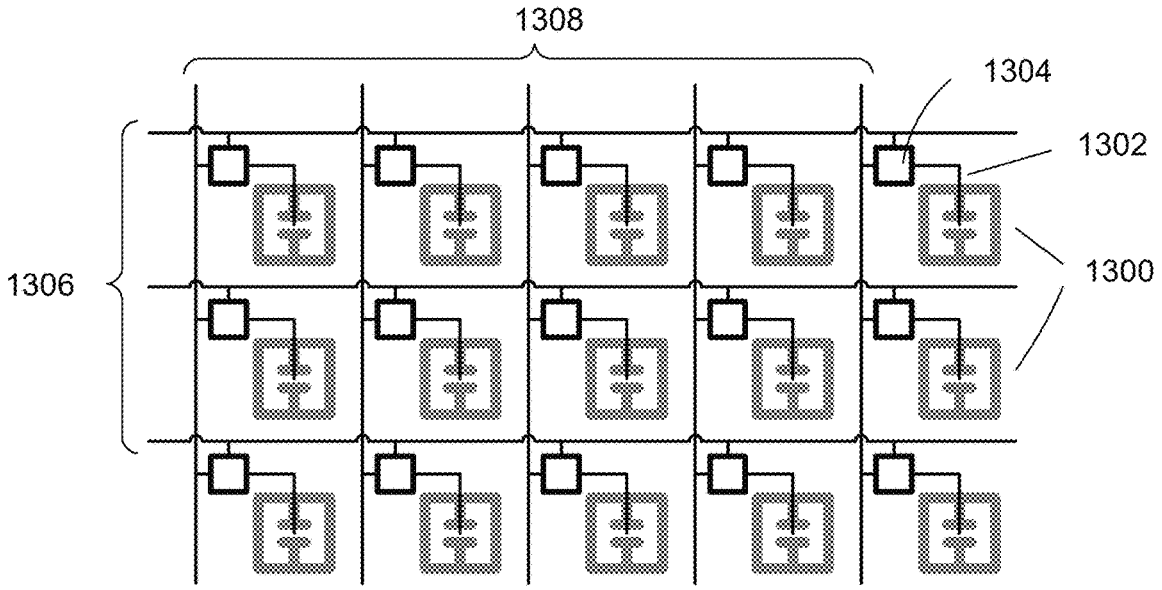
FIG. 13 depicts a surface scattering antenna with matrix addressing of the scattering elements.

In various approaches, the bias voltage lines may be directly addressed, e.g. by extending a bias voltage line for each scattering element to a pad structure for connection to antenna control circuitry, or matrix addressed, e.g. by providing each scattering element with a voltage bias circuit that is addressable by row and column. FIG. 12 depicts a example of a configuration that provides direct addressing for an arrangement of scattering elements 1200 on the surface of a microstrip 1202, in which a plurality of bias voltage lines 1204 are run along the length of the microstrip to deliver individual bias voltages to the scattering elements (alternatively, the bias voltage lines 1204 could be run perpendicular to the microstrip and extended to pads or vias along the length of the microstrip). (The figure also shows an example of how the scattering elements may be arranged having perpendicular orientations, e.g. to provide polarization control; in this arrangement, a guided wave that propagates along the microstrip has a magnetic field that is substantially oriented in the j; direction and may therefore be coupled to both orientations of the scattering elements, which produce magnetic excitations that may be substantially characterized as magnetic dipole excitations oriented at ±45° relative to the 2 direction). FIG. 13 depicts an example of a configuration that provides matrix addressing for an arrangement of scattering elements 1300 (e.g. on the surface of a parallel-plate waveguide), where each scattering element is connected by a bias voltage line 1302 to a biasing circuit 1304 addressable by row inputs 1306 and column inputs 1308 (note that each row input and/or column input may include one or more signals, e.g. each row or column may be addressed by a single wire or a set of parallel wires dedicated to that row or column). Each biasing circuit may contain, for example, a switching device (e.g. a transistor), a storage device (e.g. a capacitor), and/or additional circuitry such as logic/multiplexing circuitry, digital-to-analog conversion circuitry, etc. This circuitry may be readily fabricated using monolithic integration, e.g. using a thin-film transistor (TFT) process, or as a hybrid assembly of integrated circuits that are mounted on the wave-propagating structure, e.g. using surface mount technology (SMT). In some approaches, the bias voltages may be adjusted by adjusting the amplitude of an AC bias signal. In other approaches, the bias voltages may be adjusted by applying pulse width modulation to an AC signal.

Figure 14:
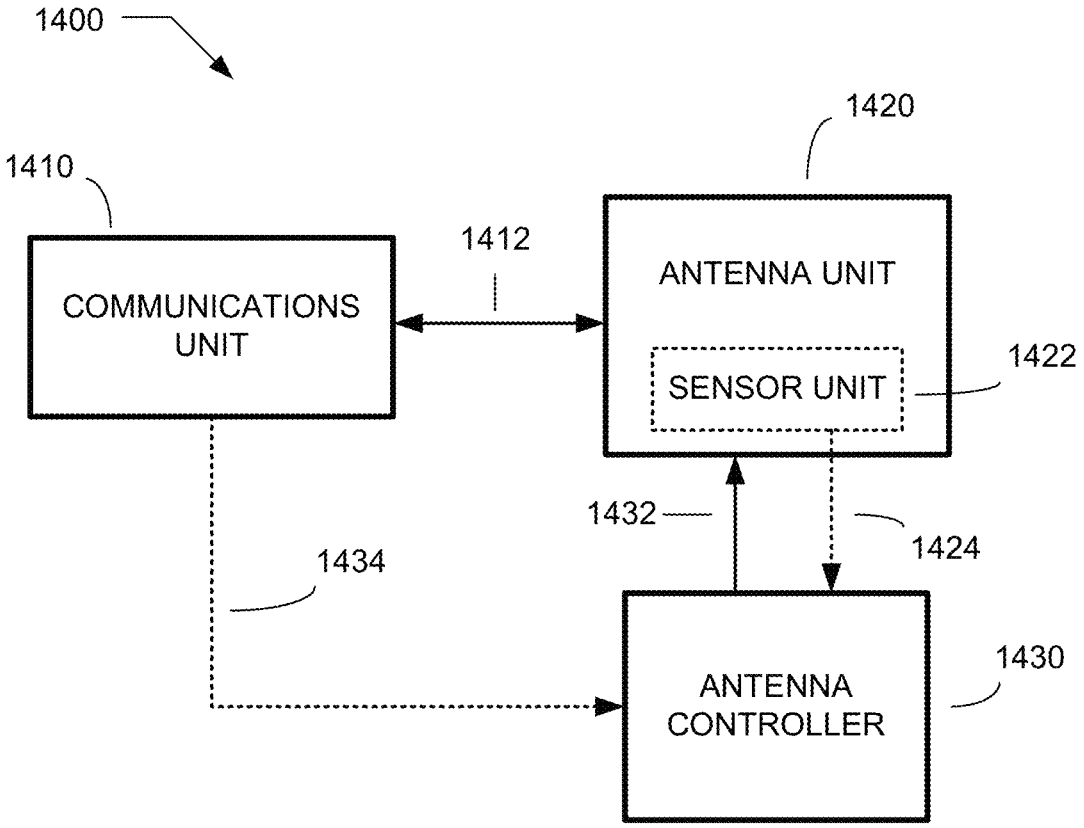
FIG. 14 depicts a system block diagram.

With reference now to FIG. 14, an illustrative embodiment is depicted as a system block diagram. The system 1400 include a communications unit 1410 coupled by one or more feeds 1412 to an antenna unit 1420. The communications unit 1410 might include, for example, a mobile broadband satellite transceiver, or a transmitter, receiver, or transceiver module for a radio or microwave communications system, and may incorporate data multiplexing/demultiplexing circuitry, encoder/decoder circuitry, modulator/demodulator circuitry, frequency upconverters/downconverters, filters, amplifiers, diplexes, etc. The antenna unit includes at least one surface scattering antenna, which may configured to transmit, receive, or both; and in some approaches the antenna unit 1420 may comprise multiple surface scattering antennas, e.g. first and second surface scattering antennas respectively configured to transmit and receive. For embodiments having a surface scattering antenna with multiple feeds, the communications unit may include MIMO circuitry. The system 1400 also includes an antenna controller 1430 configured to provide control input(s) 1432 that determine the configuration of the antenna. For example, the control inputs(s) may include inputs for each of the scattering elements (e.g. for a direct addressing configuration such as depicted in FIG. 12), row and column inputs (e.g. for a matrix addressing configuration such as that depicted in FIG. 13), adjustable gains for the antenna feeds, etc.

In some approaches, the antenna controller 1430 includes circuitry configured to provide control input(s) 1432 that correspond to a selected or desired antenna radiation pattern. For example, the antenna controller 1430 may store a set of configurations of the surface scattering antenna, e.g. as a lookup table that maps a set of desired antenna radiation patterns (corresponding to various beam directions, beams widths, polarization states, etc. as discussed earlier in this disclosure) to a corresponding set of values for the control input(s) 1432. This lookup table may be previously computed, e.g. by performing full-wave simulations of the antenna for a range of values of the control input(s) or by placing the antenna in a test environment and measuring the antenna radiation patterns corresponding to a range of values of the control input(s). In some approaches the antenna controller may be configured to use this lookup table to calculate the control input(s) according to a regression analysis; for example, by interpolating values for the control input(s) between two antenna radiation patterns that are stored in the lookup table (e.g. to allow continuous beam steering when the lookup table only includes discrete increments of a beam steering angle). The antenna controller 1430 may alternatively be configured to dynamically calculate the control input(s) 1432 corresponding to a selected or desired antenna radiation pattern, e.g. by computing a holographic pattern corresponding to an interference term $\mathrm{Re}[\Psi_{out}\Psi^*_{in}]$ (as discussed earlier in this disclosure), or by computing the couplings $\{\alpha_j\}$ (corresponding to values of the control input(s)) that provide the selected or desired antenna radiation pattern in accordance with equation (1) presented earlier in this disclosure.

In some approaches the antenna unit 1420 optionally includes a sensor unit 1422 having sensor components that detect environmental conditions of the antenna (such as its position, orientation, temperature, mechanical deformation, etc.). The sensor components can include one or more GPS devices, gyroscopes, thermometers, strain gauges, etc., and the sensor unit may be coupled to the antenna controller to provide sensor data 1424 so that the control input(s) 1432 may be adjusted to compensate for translation or rotation of the antenna (e.g. if it is mounted on a mobile platform such as an aircraft) or for temperature drift, mechanical deformation, etc.

In some approaches the communications unit may provide feedback signal(s) 1434 to the antenna controller for feedback adjustment of the control input(s). For example, the communications unit may provide a bit error rate signal and the antenna controller may include feedback circuitry (e.g. DSP circuitry) that adjusts the antenna configuration to reduce the channel noise. Alternatively or additionally, for pointing or steering applications the communications unit may provide a beacon signal (e.g. from a satellite beacon) and the antenna controller may include feedback circuitry (e.g. pointing lock DSP circuitry for a mobile broadband satellite transceiver).

Figure 15:
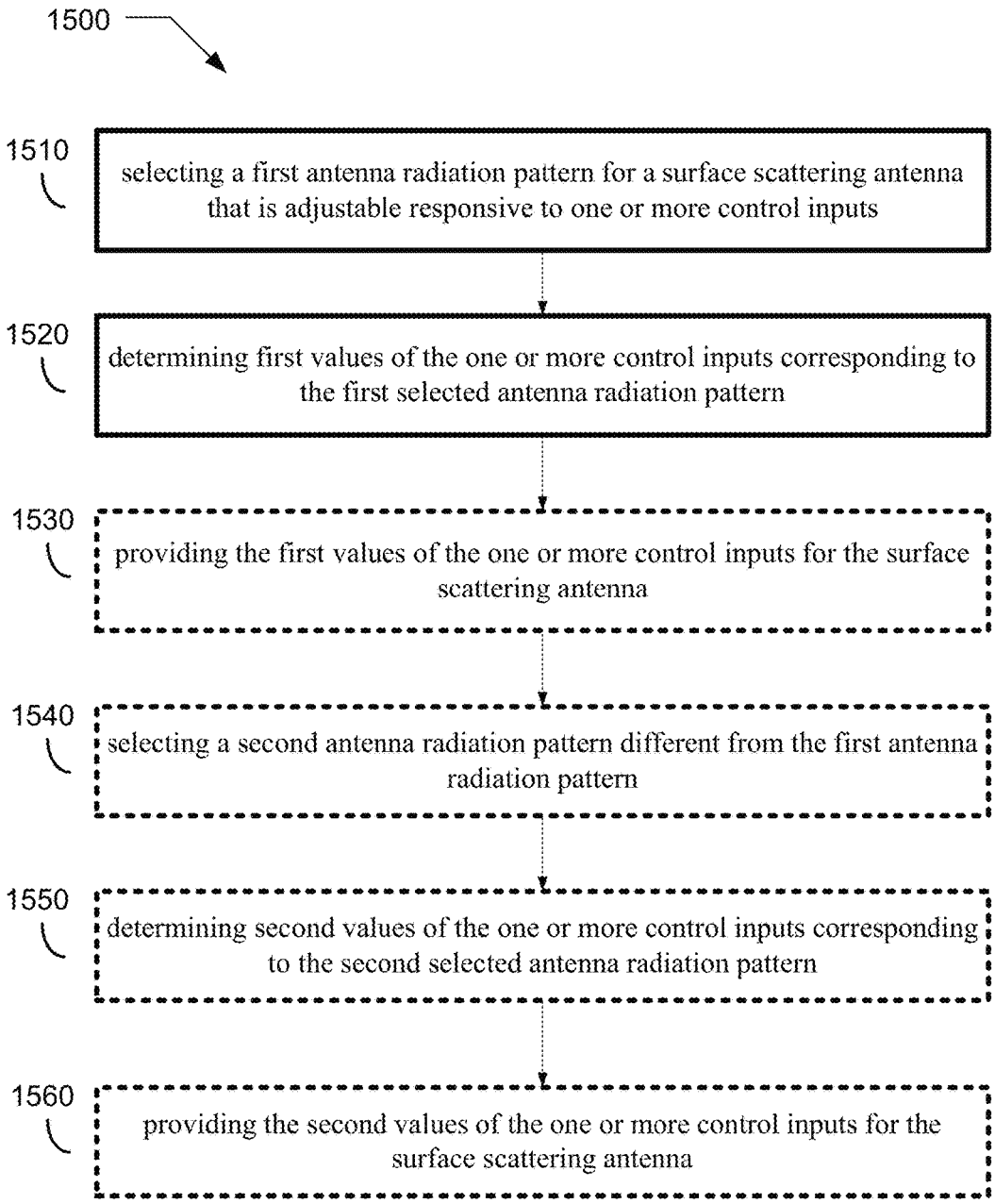
FIGS. 15 and 16 depict flow diagrams.

An illustrative embodiment is depicted as a process flow diagram in FIG. 15. Flow 1500 includes operation 1510—selecting a first antenna radiation pattern for a surface scattering antenna that is adjustable responsive to one or more control inputs. For example, an antenna radiation pattern may be selected that directs a primary beam of the radiation pattern at the location of a telecommunications satellite, a telecommunications base station, or a telecommunications mobile platform. Alternatively or additionally, an antenna radiation pattern may be selected to place nulls of the radiation pattern at desired locations, e.g. for secure communications or to remove a noise source. Alternatively or additionally, an antenna radiation pattern may be selected to provide a desired polarization state, such as circular polarization (e.g. for Ka-band satellite communications) or linear polarization (e.g. for Ku-band satellite communications). Flow 1500 includes operation 1520—determining first values of the one or more control inputs corresponding to the first selected antenna radiation pattern. For example, in the system of FIG. 14, the antenna controller 1430 can include circuitry configured to determine values of the control inputs by using a lookup table, or by computing a hologram corresponding to the desired antenna radiation pattern. Flow 1500 optionally includes operation 1530—providing the first values of the one or more control inputs for the surface scattering antenna. For example, the antenna controller 1430 can apply bias voltages to the various scattering elements, and/or the antenna controller 1430 can adjust the gains of antenna feeds. Flow 1500 optionally includes operation 1540—selecting a second antenna radiation pattern different from the first antenna radiation pattern. Again this can include selecting, for example, a second beam direction or a second placement of nulls. In one application of this approach, a satellite communications terminal can switch between multiple satellites, e.g. to optimize capacity during peak loads, to switch to another satellite that may have entered service, or to switch from a primary satellite that has failed or is off-line. Flow 1500 optionally includes operation 1550—determining second values of the one or more control inputs corresponding to the second selected antenna radiation pattern. Again this can include, for example, using a lookup table or computing a holographic pattern. Flow 1500 optionally includes operation 1560—providing the second values of the one or more control inputs for the surface scattering antenna. Again this can include, for example, applying bias voltages and/or adjusting feed gains.

Figure 16:
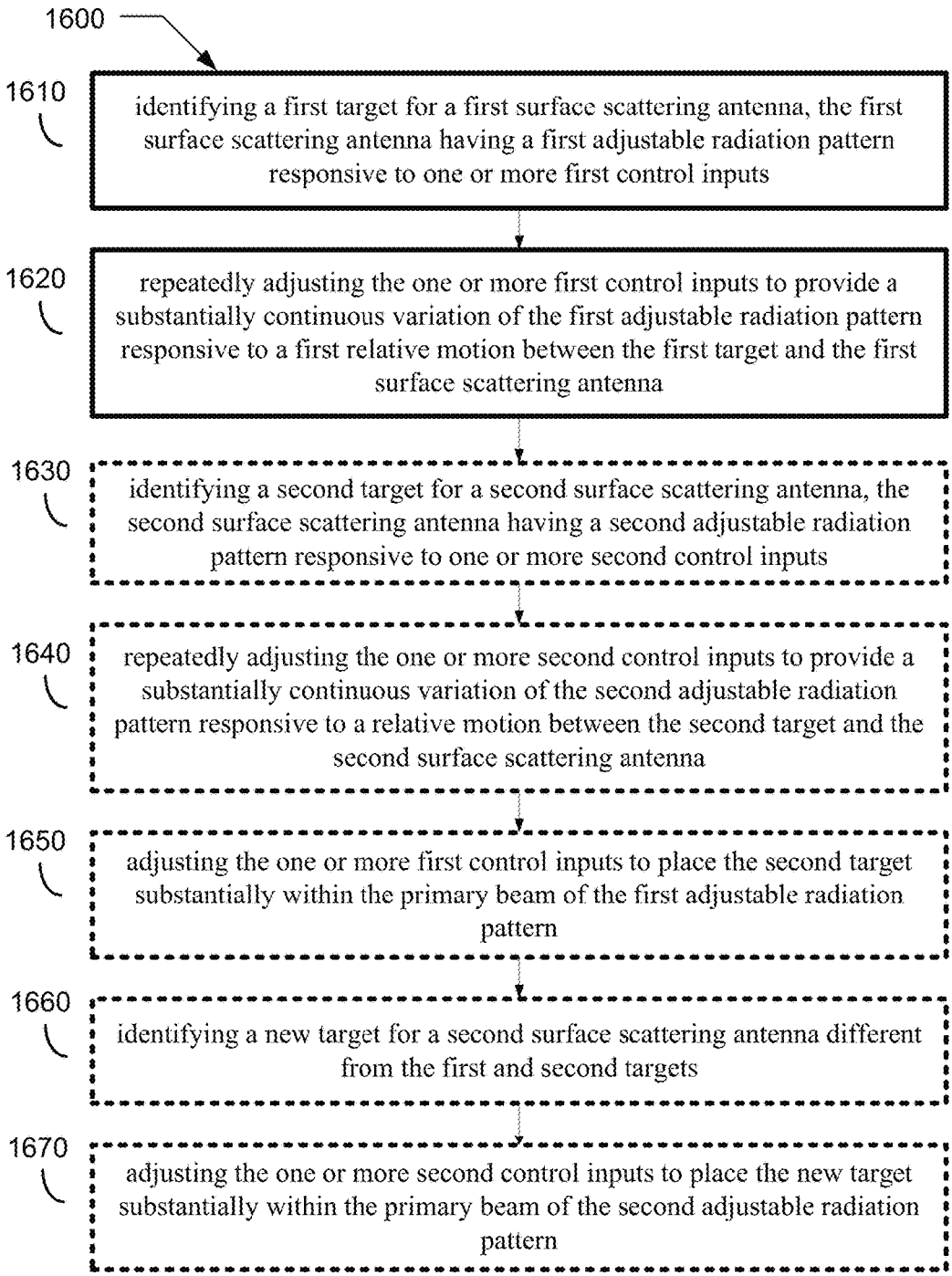

Another illustrative embodiment is depicted as a process flow diagram in FIG. 16. Flow 1600 includes operation 1610—identifying a first target for a first surface scattering antenna, the first surface scattering antenna having a first adjustable radiation pattern responsive to one or more first control inputs. This first target could be, for example, a telecommunications satellite, a telecommunications base station, or a telecommunications mobile platform. Flow 1600 includes operation 1620—repeatedly adjusting the one or more first control inputs to provide a substantially continuous variation of the first adjustable radiation pattern responsive to a first relative motion between the first target and the first surface scattering antenna. For example, in the system of FIG. 14, the antenna controller 1430 can include circuitry configured to steer a radiation pattern of the surface scattering antenna, e.g. to track the motion of a non-geostationary satellite, to maintain pointing lock with a geostationary satellite from a mobile platform (such as an airplane or other vehicle), or to maintain pointing lock when both the target and the antenna are moving. Flow 1600 optionally includes operation 1630—identifying a second target for a second surface scattering antenna, the second surface scattering antenna having a second adjustable radiation pattern responsive to one or more second control inputs; and flow 1600 optionally includes operation 1640—repeatedly adjusting the one or more second control inputs to provide a substantially continuous variation of the second adjustable radiation pattern responsive to a relative motion between the second target and the second surface scattering antenna. For example, some applications may deploy both a primary antenna unit, tracking a first object (such as a first non-geostationary satellite), and a secondary or auxiliary antenna unit, tracking a second object (such as a second non-geostationary satellite). In some approaches the auxiliary antenna unit may include a smaller-aperture antenna (tx and/or rx) used primarily used to track the location of the secondary object (and optionally to secure a link to the secondary object at a reduced quality-of-service (QoS)). Flow 1600 optionally includes operation 1650—adjusting the one or more first control inputs to place the second target substantially within the primary beam of the first adjustable radiation pattern. For example, in an application in which the first and second antennas are components of a satellite communications terminal that interacts with a constellation of non-geostationary satellites, the first or primary antenna may track a first member of the satellite constellation until the first member approaches the horizon (or the first antenna suffers appreciable scan loss), at which time a "handoff" is accomplished by switching the first antenna to track the second member of the satellite constellation (which was being tracked by the second or auxiliary antenna). Flow 1600 optionally includes operation 1660—identifying a new target for a second surface scattering antenna different from the first and second targets; and flow 1600 optionally includes operation 1670—adjusting the one or more second control inputs to place the new target substantially within the primary beam of the second adjustable radiation pattern. For example, after the "handoff," the secondary or auxiliary antenna can initiate a link with a third member of the satellite constellation (e.g. as it rises above the horizon).

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

In a general sense, those skilled in the art will recognize that the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). Those having skill in the art will recognize that the subject matter described herein may be implemented in an analog or digital fashion or some combination thereof.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

One skilled in the art will recognize that the herein described components (e.g., steps), devices, and objects and the discussion accompanying them are used as examples for the sake of conceptual clarity and that various configuration modifications are within the skill of those in the art. Consequently, as used herein, the specific exemplars set forth and the accompanying discussion are intended to be representative of their more general classes. In general, use of any specific exemplar herein is also intended to be representative of its class, and the non-inclusion of such specific components (e.g., steps), devices, and objects herein should not be taken as indicating that limitation is desired.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

With respect to the appended claims, those skilled in the art will appreciate that recited operations therein may generally be performed in any order. Examples of such alternate orderings may include overlapping, interleaved, interrupted, reordered, incremental, preparatory, supplemental, simultaneous, reverse, or other variant orderings, unless context dictates otherwise. With respect to context, even terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A system, comprising:

a surface scattering antenna that is adjustable responsive to one or more external inputs;

antenna control circuitry configured to provide the one or more external inputs; and communications circuitry coupled to a feed structure of the surface scattering antenna;

where the surface scattering antenna includes:

at least one feed connector for launching a guided wave when receiving an electromagnetic signal via the feed structure;

a waveguide arranged for propagating said guided wave; and a plurality of scattering elements distributed along the waveguide with inter-element spacings substantially less than a free-space wavelength corresponding to an operating frequency of the antenna, where the plurality of scattering elements have:

electromagnetic properties that are adjustable in response to the one or more external inputs;

a plurality of adjustable individual electromagnetic responses to said guided wave mode in the waveguide, and said adjustable electromagnetic properties and said plurality of adjustable individual electromagnetic responses provide an adjustable radiation field of the antenna when said guided wave is scattered at said plurality of scattering elements;

wherein the one or more external inputs include a plurality of respective bias voltages for the plurality of scattering elements.

2. A system, comprising:

a surface scattering antenna that is adjustable responsive to one or more external inputs;

antenna control circuitry configured to provide the one or more external inputs; and communications circuitry coupled to a feed structure of the surface scattering antenna;

where the surface scattering antenna includes:

at least one feed connector for launching a guided wave when receiving an electromagnetic signal via the feed structure;

a waveguide arranged for propagating said guided wave; and a plurality of scattering elements distributed along the waveguide with inter-element spacings substantially less than a free-space wavelength corresponding to an operating frequency of the antenna, where the plurality of scattering elements have:

electromagnetic properties that are adjustable in response to the one or more external inputs;

a plurality of adjustable individual electromagnetic responses to said guided wave mode in the waveguide, and said adjustable electromagnetic properties and said plurality of adjustable individual electromagnetic responses provide an adjustable radiation field of the antenna when said guided wave is scattered at said plurality of scattering elements;

wherein the antenna control circuitry includes: a storage medium that includes a lookup table mapping a set of antenna radiation pattern parameters to a corresponding set of values for the one or more control inputs.

3. The system of claim 2, wherein the set of antenna radiation pattern parameters includes a set of antenna beam directions.

4. The system of claim 2, wherein the set of antenna radiation pattern parameters includes a set of antenna null directions.

5. The system of claim 2, wherein the set of antenna radiation pattern parameters includes a set of antenna beam widths.

6. The system of claim 2, wherein the set of antenna radiation pattern parameters includes a set of polarization states.

7. A system, comprising:

a surface scattering antenna that is adjustable responsive to one or more external inputs;

antenna control circuitry configured to provide the one or more external inputs; and communications circuitry coupled to a feed structure of the surface scattering antenna;

where the surface scattering antenna includes:

at least one feed connector for launching a guided wave when receiving an electromagnetic signal via the feed structure;

a waveguide arranged for propagating said guided wave; and a plurality of scattering elements distributed along the waveguide with inter-element spacings substantially less than a free-space wavelength corresponding to an operating frequency of the antenna, where the plurality of scattering elements have:

electromagnetic properties that are adjustable in response to the one or more external inputs;

a plurality of adjustable individual electromagnetic responses to said guided wave mode in the waveguide, and said adjustable electromagnetic properties and said plurality of adjustable individual electromagnetic responses provide an adjustable radiation field of the antenna when said guided wave is scattered at said plurality of scattering elements;

wherein the antenna control circuitry includes: processor circuitry configured to calculate a set of values for the one or more external inputs corresponding to a desired antenna radiation pattern parameter.

8. The system of claim 7, wherein the processor circuitry is configured to calculate the set of values for the for the one or more external inputs by computing a holographic pattern corresponding to the desired antenna radiation pattern parameter.

9. A system, comprising:

a surface scattering antenna that is adjustable responsive to one or more external inputs;

antenna control circuitry configured to provide the one or more external inputs; and communications circuitry coupled to a feed structure of the surface scattering antenna;

where the surface scattering antenna includes:

at least one feed connector for launching a guided wave when receiving an electromagnetic signal via the feed structure;

a waveguide arranged for propagating said guided wave; and a plurality of scattering elements distributed along the waveguide with inter-element spacings substantially less than a free-space wavelength corresponding to an operating frequency of the antenna, where the plurality of scattering elements have:

electromagnetic properties that are adjustable in response to the one or more external inputs;

a plurality of adjustable individual electromagnetic responses to said guided wave mode in the waveguide, and said adjustable electromagnetic properties and said plurality of adjustable individual electromagnetic responses provide an adjustable radiation field of the antenna when said guided wave is scattered at said plurality of scattering elements;

and further comprising: a sensor unit configured to detect an environmental condition of the surface scattering antenna.

10. The system of claim 9, wherein the sensor unit includes one or more sensors selected from GPS sensors, thermometers, gyroscopes, accelerometers, and strain gauges.

11. The system of claim 9, wherein the environmental condition includes a position, an orientation, a temperature, or a mechanical deformation of the surface scattering antenna.

12. The system of claim 9, wherein the sensor unit is configured to provide environmental condition data to the antenna control circuitry, and the antenna control circuitry includes:

circuitry configured to adjust the one or more external inputs to compensate for changes in the environmental condition of the surface scattering antenna.

13. A surface scattering antenna, comprising:

at least one feed connector for launching a guided wave when receiving an electromagnetic signal via a feed structure;

a waveguide arranged for propagating said guided wave; and a plurality of scattering elements distributed along the waveguide with inter-element spacings substantially less than a free-space wavelength corresponding to an operating frequency of the antenna, where the plurality of scattering elements have:

electromagnetic properties that are adjustable in response to one or more external inputs;

a plurality of adjustable individual electromagnetic responses to said guided wave mode in the waveguide, and said adjustable electromagnetic properties and said plurality of adjustable individual electromagnetic responses provide an adjustable radiation field of the antenna when said guided wave is scattered at said plurality of scattering elements.

14. The antenna of claim 13, wherein the waveguide includes one or more conducting surfaces and the plurality of scattering elements corresponds to a plurality of apertures within the one or more conducting surfaces; and wherein the plurality of apertures defines a respective plurality of conducting islands that are electrically disconnected from the one or more conducting surfaces, and the antenna further comprises:

a plurality of bias voltage lines or biasing circuits configured to provide respective bias voltages between the one or more conducting surfaces and the respective plurality of conducting islands.

15. The antenna of claim 14, wherein the operating frequency is a microwave frequency.

16. The antenna of claim 14, wherein the wave-propagating structure is a substantially two-dimensional wave-propagating structure.

17. The antenna of claim 16, wherein the substantially two-dimensional wave-propagating structure is a parallel plate waveguide, and the one or more conducting surfaces are an upper conductor of the parallel plate waveguide.

18. The antenna of claim 14, wherein the wave-propagating structure includes one or more substantially one-dimensional wave-propagating structures.

19. The antenna of claim 18, wherein the one or more substantially one-dimensional wave-propagating structures are a plurality of substantially one-dimensional wave-propagating structures composing a substantially two-dimensional antenna area.

20. The antenna of claim 18, wherein the one or more substantially one-dimensional wave-propagating structures include one or more closed waveguides.

21. The antenna of claim 20, wherein the one or more closed waveguides include one or more rectangular waveguides.

22. The antenna of claim 20, wherein the one or more conducting surfaces are one or more respective upper surfaces of the one or more closed waveguides.

23. The antenna of claim 20, wherein the one or more conducting surfaces are positioned above one or more respective upper surfaces of the one or more closed waveguides, and the one or more respective upper surfaces include a plurality of irises adjacent to the plurality of apertures within the one or more conducting surfaces.

24. The antenna of claim 14, wherein the plurality of apertures are arranged in rows and columns, the plurality of bias voltage lines or biasing circuits is a plurality of biasing circuits, and the antenna further comprises:

a set of row control lines each addressing a row of the plurality of biasing circuits; and a set of column control lines each addressing a column of the plurality of biasing circuits.

25. The antenna of claim 14, further comprising:

an electrically adjustable material disposed at least partially within respective vicinities of the plurality of apertures.

26. The antenna of claim 25, wherein the electrically adjustable material is a liquid crystal material.

27. The antenna of claim 14, wherein the scattering elements include active elements and the bias voltages are bias voltages for the active elements.

28. The antenna of claim 27, wherein the active elements are selected from varactors, transistors, or diodes.

29. The antenna of claim 13, wherein the one or more external inputs include a plurality of respective bias voltages for the plurality of scattering elements.

30. The antenna of claim 13, further comprising antenna control circuitry configured to provide the one or more external inputs, wherein the antenna control circuitry includes a storage medium that includes a lookup table mapping a set of antenna radiation pattern parameters to a corresponding set of values for the one or more control inputs.

31. The antenna of claim 30, wherein the set of antenna radiation pattern parameters includes a set of antenna beam directions, antenna null directions, antenna beam widths, or polarization states.

32. The antenna of claim 13, further comprising antenna control circuitry configured to provide the one or more external inputs, wherein the antenna control circuitry includes processor circuitry configured to calculate a set of values for the one or more external inputs corresponding to a desired antenna radiation pattern parameter.

33. The antenna of claim 13, further comprising a sensor unit configured to detect an environmental condition of the surface scattering antenna.

34. The antenna of claim 33, wherein the sensor unit includes one or more sensors selected from GPS sensors, thermometers, gyroscopes, accelerometers, and strain gauges.

35. The antenna of claim 33, wherein the environmental condition includes a position, an orientation, a temperature, or a mechanical deformation of the surface scattering antenna.

36. The antenna of claim 33, further comprising antenna control circuitry configured to provide the one or more external inputs, wherein the sensor unit is configured to provide environmental condition data to the antenna control circuitry, and the antenna control circuitry includes:

circuitry configured to adjust the one or more external inputs to compensate for changes in the environmental condition of the surface scattering antenna.

* * * * *